US010024121B2

(12) United States Patent
Wajnikonis

(10) Patent No.: US 10,024,121 B2
(45) Date of Patent: Jul. 17, 2018

(54) FLEXIBLE HANG-OFF FOR A RIGID RISER

(71) Applicant: Krzysztof Jan Wajnikonis, Rosharon, TX (US)

(72) Inventor: Krzysztof Jan Wajnikonis, Rosharon, TX (US)

( * ) Notice: Subject to any disclaimer, the term of this patent is extended or adjusted under 35 U.S.C. 154(b) by 0 days.

(21) Appl. No.: 15/575,598

(22) PCT Filed: May 27, 2016

(86) PCT No.: PCT/US2016/034532

§ 371 (c)(1),
(2) Date: Nov. 20, 2017

(87) PCT Pub. No.: WO2016/191637

PCT Pub. Date: Dec. 1, 2016

(65) Prior Publication Data

US 2018/0155994 A1 Jun. 7, 2018

Related U.S. Application Data

(60) Provisional application No. 62/166,838, filed on May 27, 2015, provisional application No. 62/168,861, (Continued)

(51) Int. Cl.
*E21B 17/01* (2006.01)
*E21B 19/00* (2006.01)

(52) U.S. Cl.
CPC ..... *E21B 19/006* (2013.01); *E21B 17/01* (2013.01)

(58) Field of Classification Search
CPC ..... E21B 17/01; E21B 17/015; E21B 17/017; E21B 19/004; E21B 19/006
See application file for complete search history.

(56) References Cited

U.S. PATENT DOCUMENTS 4,456,073 A * 6/1984 Barth ..... E21B 17/01 166/355
4,915,416 A * 4/1990 Barrett ..... B63B 22/021 141/387

(Continued)

FOREIGN PATENT DOCUMENTS

AU 2008211995 B2 4/2009
AU 2010238542 B2 11/2010

(Continued)

OTHER PUBLICATIONS

K.J. Wajnikonis, PCT/US16/34532 amended by IPEA/US + Prelim. Report, dated Nov. 2, 2016/ Nov. 29, 2016/ Dec. 28, 2016.

(Continued)

*Primary Examiner* — Matthew R Buck

(57) ABSTRACT

Flexible riser hang-off for rigid risers deployed offshore is provided and called a spoolflex hang-off. The spoolflex hang-off utilizes combined torsional and bending flexibilities of a rigid tubular jumper deployed between a top of the riser and a floater piping. The rigid jumper transports fluids, contains the fluid pressure and accommodates angular deflections of the riser. The riser top is suspended from a pivoting arrangement that transfers the riser tension to the floater structure. The rigid jumper can be made of titanium or of other metallic or nonmetallic materials.

The flexible riser hang-off provided has rotational stiffness independent on riser tension. Low static and fatigue bending loads on the riser and on the floater structure result. The hang-off allows large riser deflection angles.

20 Claims, 9 Drawing Sheets

Related U.S. Application Data filed on May 31, 2015, provisional application No. 62/185,749, filed on Jun. 29, 2015, provisional application No. 62/189,437, filed on Jul. 7, 2015, provisional application No. 62/201,157, filed on Aug. 5, 2015, provisional application No. 62/214,265, filed on Sep. 4, 2015.

(56) References Cited

U.S. PATENT DOCUMENTS

| | | | | |
|---|---|---|---|---|
| 5,269,629 | A | 12/1993 | Langner | |
| 5,927,902 | A * | 7/1999 | Sveen | E21B 17/085 137/615 |
| 6,739,804 | B1 * | 5/2004 | Haun | E21B 17/015 166/355 |
| 8,550,171 | B2 * | 10/2013 | Wajnikonis | E21B 17/015 166/346 |
| 8,689,882 | B2 * | 4/2014 | Wajnikonis | E21B 17/015 166/343 |
| 8,888,411 | B2 | 11/2014 | Wajnikonis | |
| 2008/0223583 | A1 * | 9/2008 | Roveri | B63B 27/24 166/336 |
| 2011/0162748 | A1 * | 7/2011 | Morand | E21B 17/01 138/109 |
| 2012/0107050 | A1 * | 5/2012 | Wolbers | B63B 27/24 405/171 |

FOREIGN PATENT DOCUMENTS

| | | | | |
|---|---|---|---|---|
| EP | 2042682 | A3 | 12/2013 | |
| WO | WO-0130646 | A1 * | 5/2001 | E21B 17/015 |
| WO | WO 2014180687 | A1 | 4/2014 | |
| WO | WO 2016/168797 | A1 | 10/2016 | |

OTHER PUBLICATIONS

C.G. Langner, OTC 15104, May 5-8, 2003.
C.F. Baxter, R.W. Schultz, C.S. Caldwell, OTC 18624, Apr. 30-May 3, 2007.
K.J. Wajnikonis, S.J. Leverette, OTC 20180, May 4-7, 2009.
K.J. Wajnikonis, S.J. Leverette, OTC 20180 presentation, May 4-7, 2009.
Intervention-Y Brochure 1.
Intervention-Y Brochure 2.

* cited by examiner

FLEXIBLE HANG-OFF FOR A RIGID RISER

This specification claims the benefit of priority related to U.S. Provisional Patent Applications No. 62/166,838 filed on May 27, 2015 No. 62/168,861 filed on May 31, 2015, 62/185,749 of Jun. 29, 2015, No. 62/189,437 filed on Jul. 7, 2015, No. 62/201,157 filed on Aug. 5, 2015 and 62/214,265 of Sep. 4, 2015.

TECHNICAL FIELD

This invention relates to improved riser hang-off devices that accommodate angular deflections of riser tops relative floating vessels or buoys from which the said risers are suspended. The riser hang-offs can be located below the water surface, at the water surface or above the water surface.

This specification claims the benefit of priority related to PCT Patent Application PCT/US16/34532 filed May 27, 2016, of which this is the US National filing, U.S. Provisional Patent Applications No. 62/166,838 filed on May 27, 2015 No. 62/168,861 filed on May 31, 2015, 62/185,749 of Jun. 29, 2015, No. 62/189,437 filed on Jul. 7, 2015, No. 62/201,157 filed on Aug. 5, 2015 and 62/214,265 of Sep. 4, 2015.

BACKGROUND ART

Rigid riser hang-off devices are important pieces of equipment in offshore engineering. Until now two types of devices have been used for that purpose:

- Flex joints according to U.S. Pat. No. 5,269,629 by Langner,
- Tapered Transition Joints (TSJs).

Those are primarily used for hang-offs or Steel Catenary Risers (SCRs), which are the most common, including steel lazy wave risers. Other relevant types of rigid risers are for example Chinese lantern riser, bottom weighed riser, etc., and rigid catenary jumpers 'U' and 'W' shaped.

The use of the flex joints is limited to low and medium design temperatures and low to medium design pressures. At high temperatures and high pressures (HTHP) the only devices that have been used to date are TSJs. The use of steel TSJs to handle angular deflections at high tensions is limited to small deflection angles. At high effective tension and large angular deflections a steel TSJ would have been prohibitively long, and that is why titanium TSJs are used, see OTC 18624.

The load characteristics, design details and limitations of both flex joints and TSJs are well known to those skilled in the art.

Titanium TSJs and flex joints are mostly used in standard SCR top deflection angle ranges with the upper limit of approximately 20° to 25°. For greater deflection angles titanium TSJs would have been very long and expensive. Two stage flex joints can handle deflection angles up to 35° to 40°, albeit at considerably increased costs. Flexible risers are therefore used in medium and shallow water applications that require high deflection angles; however, flexible pipe cannot handle HTHPs.

In the nineties deployment of SCRs supported from a turret of a Floating Production Storage and Offloading (FPSO) vessel for Gulf of Mexico (GoM) project(s) were considered. Shell investigated a use of flex joints utilizing typical receptacle baskets, which was proven feasible but all details are confidential. The first turret moored FPSO utilizing lazy wave SCRs BC-10 (Shell) was installed in 2009 offshore Brazil, inclined I-tube pulled SCRs utilizing flex joints were used. The first disconnectable turret FPSO using SCRs (Shell Stones) should start production in the GoM in 2016. WO2014180667 by Cao et al also features inclined I-tubes for steel risers used with a disconnectable turret buoy.

The third type of hang-off devices is the so called 'spiralflex' disclosed in U.S. Pat. Nos. 8,550,171 and 8,689,882, Australian Patents 2008,211,995 and 2010,238,542 and in European Patent 2,042,682 by Wajnikonis and Leverette. The spiralflex separates the structural functions:

- The riser is suspended from a pivot that transfers riser tension to the vessel;
- Fluid transport, pressure containment and angular deflections are accommodated by spiralflex spools that in all the implementations disclosed by U.S. Pat. No. 8,550,171 etc. consist of entry spools, coils (spirals) and exit spools.

Wajnikonis and Leverette claim the use of catenary riser hang-off clamps with fluid conduit coils featuring two or more turns. There are no known offshore applications of the spiralflex to date.

Spiralflex hang-off according to Wajnikonis and Leverette is difficult to install. There are difficulties to work around a need to thread handling equipment like shackles, crane hooks, tri-plates, etc. through the coils. Another problem is that most designs by Wajnikonis and Leverette would require indirect two or more lifting points of the SCR by using pulleys, additional handling equipment, etc. that would be difficult to control. Another group of problems concerns the assembly, handling and protecting the coils during S-lays, J-lays or reel-lays, in cases of riser installations with Spiralflex spools assembled on risers. Spiralflex has problems in handling high deflection angles—high pitch implying large dimensions may be required to prevent closing up gaps between neighboring coil turns. Spiralflex designs tend to have large size and would be difficult or impossible to adapt for coiled tubing or wireline interventions. Because of the size of the coil, the riser porch may need to be offset more from the vessel side, which increases static bending moments acting on the porch and on the vessel structure adjacent. These static loads would be higher than those pertaining to the use of flex joints or titanium TSJs.

Spiralflex uses a fairly long three-dimensional (3-D) pipe with all the natural oscillation modes of a beam of the same length, plus additional low frequency modes. The latter are present because of the large effective lump mass of two or more turns coils that are suspended on the entry and exit spools forming slender, compliant member-springs. Another group of (predominantly) low frequency modes are governed by axial oscillation modes of coils. Those features imply greater vortex induced vibration (VIV) susceptibility of spiralflex spools than is that of straight pipe spans or of rigid jumpers of the same lengths.

Another issue is flow assurance. SCR tend to be designed with an angular offset from the vertical at the hang-off locations. Those offsets are typically of the order of 10°. The hang-off angles are usually greater than the slope angles in spiralflex coils are, which imply alternating ascending and descending flow when the product flows around the spiralflex coil. To alleviate that the coil pitch may be increased which would imply increases in the coil length. The alternating ascending and descending coil segments would allow stagnant liquids to remain in the lower parts of coil turns promoting hydrate formation and corrosion.

For SCR installations featuring flex joints and TSJs the top of the riser is one of the two riser regions that are loaded the highest in fatigue, the other one is the touch-down zone (TDZ). On fields where the seabed is soft like in the Gulf of Mexico, much of Offshore Brazil and Offshore West Africa, the TDZ fatigue damage may be not as high as is that near the riser top, see OTC 15104. Bending fatigue is the main potential failure mode for risers. At the riser top it is governed by the rotational stiffness of the hang-off and the bending fatigue damage can be very high for rigid risers utilizing TSJs and still fairly high for flex joint hang-offs. Riser fatigue is often the main criterion for the selection of a type of a floater to be used. Whenever the riser fatigue is limited, in particular the bending fatigue, less expensive vessels can be used. Those would be semi submersibles or ship-shaped FPSOs or Floating Storage Offloading (FSOs) vessels that move more on waves. Otherwise moving less, but more expensive vessels like Tension Leg Platforms (TLPs) or Spar platforms must be used.

DISCLOSURE OF INVENTION

This invention builds on the advantages of the spiralflex and simultaneously removes or mitigates its disadvantages.

The main feature of this invention in comparison with the spiralflex is that the spoolflex hang-off or the short, smart jumper spool (SJS) hang-off of a riser according to this invention does not need to include a coil (spiral). Optionally, a short partial turn loop may be included in the SjS hang-off according to this invention, but such a partial loop would differ from a spiralflex coil by the fact that instead of using two or more complete turns (spiralflex), such a partial loop would not close even one complete turn.

Accordingly, the SJS resulting is open at least on one side in all the spool designs according to this invention. Let's call it having an open plan or an open plan shape. That removes installation problems: the riser can be installed like a conventional SCR, and the open plan SJS can be installed later like a 'closing' piping spool in one or in more segments. VIV performance of SJSs is comparable with those of classic rigid jumpers, some of which are longer and have more complicated shapes than SJSs have.

Apart from the above, the SJS riser hang-off according to this invention:

- The riser is suspended from a pivot that transfers riser tension and shear forces to the vessel; the specific pivot type used is immaterial, ball joints, gimbals, universal joints, flex joints, chain, shackles, etc. can be used as pivots.
- Fluid transport, pressure containment and angular deflections are accommodated by SJSs that consist of entry and exit spools welded, flanged or connected directly to each other, without a presence of any coil. Optionally a partial loop can be present.

It follows, that the rotational stiffness of an SJS hang-off is independent on riser tension. Another advantage of the separation between the axial and bending loads on riser hang-offs provided by this invention is that the greatly reduced bending loads are transferred to the floater structure at piping supports as forces acting on large arms. Those forces are relatively small and they are distributed over large areas of the floater structure. When SJS riser hang-offs are used on turrets, disconnectable buoys, etc., more design freedom in the functional design is achieved thanks to the separation of the structural load-paths and the fluid conduit paths. The impossibility of that separation in the designs currently used is their limiting factor, with inclined I-tubes used and all design complications pertaining. PS SJS hang-offs have no high pressure or high temperature (HPHT) limitations, in the sense that whatever any rigid riser (including any metallic riser) can tolerate, so can tolerate the SJS hang-off. The pivoting arrangement used is best located in the vicinity of the top of the rigid riser, in the preferred implementations of this invention essentially on the tangent to the riser at its top. The word 'essentially' is used everywhere in this Specification and in the claims as a synonym of 'substantially' with its usual meaning of including the object, feature, class, etc. described and all objects, features, classes, etc. similar or resembling, etc.

In the SJS geometry:

- The gooseneck incorporates a pipe bend located near the top part of the riser possibly with optional straight segment(s) adjacent;
- The entry spool is defined as the SJS part incorporating two bends, the gooseneck bend included, and optional straight segments adjacent to the above bends,
- The exit spool is defined as the SJS part including up to two bends and optional straight segments adjacent to those bends that are not incorporated in the entry spool; the exit spool ends at the first clamp support of the piping of the floater (vessel, platform, buoy, turret, etc.);
- The SJS can optionally include a pup pipe bend of a sustained angle not exceeding 20° located near one of the ends of the SJS, see pup bends 785, 786, 787, 788 on FIG. 7;
- The optional partial loop is defined as the remaining part of the SJS between the entry and the exit spools that is a part of neither the entry spool nor of the exit spool.
- In any SJS installation the gooseneck can be replaced by an optional Intervention 'Y' that would thus also be a part of the entry spool.

The above definitions used herein are consistent with the terminology used in Wajnikonis and Leverette.

The SJS according to this invention would typically be made of titanium, carbon steels, low alloy steels, corrosion resistant alloys (CRAs) including austenitic, martensitic duplex and super-duplex steels, chromium based alloys, nickel based alloys (Inconels), incalloys, duplex, super-duplex, aluminum alloys, magnesium alloys, bronze alloys, brass alloys or be built of other metallic materials. SJSs can also be made of high strength, low elastic modulus non-metallic materials like fiber reinforced plastics (FRPs) utilizing carbon fibers, graphite fibers, aramid fibers (Kevlar®), glass fibers, bonded or unbonded flexible pipe etc. A titanium SJS can easily accommodate large angular deflections of 20°, 25°, 30°, 40° and more (more than 60° deflections may be feasible with a use of titanium), while at the same time hang-off devices according to this invention have rotational spring stiffnesses considerably smaller than those equivalent flex joints would have. Where a flex joint cannot be used, SJS according to this invention have orders of magnitude lower rotational spring stiffnesses than equivalent titanium TSJs would have for any low temperature/pressure, medium temperature/pressure or HPHT application. For applications where very large angular deflections are not required (i.e. in the currently used regular deflection range), SJSs can be built out of steel, duplex, super-duplex, nickel alloys, etc. or from other high elastic modulus high strength materials. They can be lined, clad or weld-overlaid with other materials including CRAs.

Many SJSs according to this invention describe in their plan view arcs that can be contained in relatively small sectors of circles, and accordingly they can be suspended from a pivot located very near the vessel side. Those result in short riser porches or receptacles, like those used to support flex joints or TSJs. Consequently static bending loads on the riser receptacles or porches and on the vessel structure are considerably reduced in comparison with those experienced by similar devices supporting spiralflex hang-offs.

SJSs provided with optional partial loops can feature partial loops that describe in their plan shapes combined angles between 0° and 359°. In cases where the partial loop is circular, any curved segment extent between 0° and 359° can be used. In cases less than 359° like for example 90° or close to 90° bends are used to build the partial loop, the partial loop extents can be close to multiples of 90°, i.e. values close to 90°, 180° or 270°. Partial loops can also incorporate bends different from 90° bends, like for example 180° bend(s), 270° bends or bends featuring any different sustained angles (like for example close to 120° to result in segments of triangular plan shape partial loops that are augmented in multiples of 120° (or those of any other angle or combinations of angles), rather than those of 90°. See Wajnikonis and Leverette for an analogous drawing of a triangular shape spiralflex coil. Optional partial loops can also describe in their plan shapes any combined angles, in the range between 270° and 359°, like for example 300°, 315°, 330°, 340° or 350°. The partial loops can be planar, essentially horizontal, or they can be given non-zero average slope angles. Planar partial loops result in shorter extents of SJSs in the riser axial direction.

SJSs are preferably built of planar bends welded, flanged or connected together. Induction bends are preferable. However, segments of SJSs can be also built of curved segments incorporating curvature and twist, like for example helicoidal segments. Essentially helix shaped segments or other 3-D spools can be approximated with planar bends by introducing twist angles between planes tangent to wirelines of the neighboring bends. All the 3-D design examples herein, as well as those shown in Wajnikonis and Leverette use that technique while utilizing exclusively planar bends. Introducing twist angles while combining bends can be carried out both for planar and for 3-D bends.

Welds, connectors or flanges utilized in the construction of SJSs are preferably located on the straight segments for structural and technological reasons. The use of connectors is preferable, in particular of those disclosed in PCT Patent Application PCT/US2016/028033 by this applicant. The use of those connectors allows welding to very high standards both from inside and from outside of a pipe and subsequently grinding and polishing the welds both from the outside and from the inside. That technique is successfully used in tendon and riser engineering and it results in very long fatigue life of the welds with similar Merlin™ type connectors. Thermal treatment of welds is also easier. Connectors according to PCT/US2016/028033 can be also machined in pipe ends being connected without welding. Alternatively welding from outside can be used, or welding, grinding and polishing the welds both from the outside and from the inside that would require developing specialized tools.

SJSs are protected from VIVs using strakes, 3-D dampers, perforated shrouds or fairings. They can be also protected from current and wave loads by sheltering or partial sheltering of their lengths behind other equipment, floater, turret or buoy functional or structural elements or by specially installed shrouds.

The hang-off configurations according to this invention presented herein should be regarded as examples only; many other configurations not shown are also feasible under this invention and they should have similar characteristics. All the example SJS geometries depicted herein originate at the same side for example consistency and easier comparisons. Mirror image geometries reflected with regard to the in-plane (IP) plane of the risers will have the same dimensions and are expected to have the same rotational characteristics reflected.

The low rotational spring constants of hang-of designs according to this invention in comparison with those of TSJs and flex joints result in considerable improvements in the bending fatigue near the tops of rigid risers. When generic pivots are used as parts of the hang-off there is no fatigue damage improvement with regard to the axial load fatigue. However, in particular cases where tendon-like flex joints are used for pivots, some small axial spring flexibility is added, which would result in small improvements in the axial fatigue loading along the entire length of the SCR, and also some improvement in the touch-down-zone (TDZ) fatigue. The sizing of the pivot flex joint can be optimized for achieving optimal balance between its rotational and axial load flexibilities in order to achieve the desired balance between the dynamic bending and the axial stressing of the riser. Additional optional axial flexibility can be added by including optional elastomeric bearing 'washer like' pad between the flex joint or other pivot and the riser porch, or by adding for optional axial cushioning a pneumatic nitrogen pressurized cylinder, a hydraulic cylinder with a nitrogen expansion tank, etc. and possibly with optional damping. Those solutions effective under SCR tension, rather than compression can be also used. That can be incorporated in the axial load path of the pivot—hang-off clamp extension member (if used)—hang-off clamp. Additional improvements in TDZ fatigue can be achieved by decreasing the average slopes of SCR catenaries, changing SCR configurations from free hanging to lazy wave or to short lazy wave and by a use of 3-D dampers instead of strakes or other VIV suppressors, see U.S. Pat. No. 8,888,411 and in OTC 20180.

This invention involves a flexible hang-off arrangement for a rigid riser including at least one of a rigid catenary riser, or a metallic catenary riser, or a metallic lazy wave riser, or a steel catenary riser, or a steel lazy wave riser, or a titanium catenary riser, or a titanium lazy wave riser, or a Chinese lantern riser, or a bottom weighed riser, or a fiber reinforced plastic catenary riser, or a fiber reinforced plastic lazy wave riser, or a 'U' shaped rigid catenary jumper, or a 'W' shaped rigid lazy wave jumper;

whereas said rigid riser is indirectly attached to a floater including at least one of a floating platform, or a semi-submersible platform, or a tension leg platform, or a spread moored vessel, or a turret moored vessel, or a disconnectable turret moored vessel, or a floating buoy, or a submerged buoy;

said rigid riser being suspended from a pivoting arrangement attached by fixed means to said floater; said pivoting arrangement being located in a vicinity of a top of said rigid riser, including said pivoting arrangement essentially coinciding with said top of said rigid riser;

said pivoting arrangement including at least one of a ball joint, or a gimbal, or a universal joint, or a flex joint, or a set of shackles, including a single shackle, or a set of chain links, including a single chain link;

whereas:

a fluid transferred between said rigid riser and said floater and a pressure of said fluid transferred between said rigid riser and said floater are contained in a rigid jumper; whereas said rigid jumper connects a region of said top of said rigid riser, including said top of said rigid riser, with at least one of a piping system of said floater, or a piping system of a turret, or a piping system of a disconnectable turret buoy;

said rigid jumper accommodates rotational deflections of said top of said rigid riser relative said floater;

said rigid jumper includes a gooseneck incorporating a pipe bend, said gooseneck being attached to said rigid riser essentially in said region of said top of said rigid riser in a manner consistent with design pigability requirements of a system of said rigid riser and said rigid jumper and said piping system of said floater;

said gooseneck being incorporated in an entry spool incorporated in said rigid jumper; whereas said entry spool incorporated in said rigid jumper is located at a riser end of said rigid jumper;

whereas said entry spool incorporates two pipe bends, including the pipe bend incorporated in said gooseneck, and whereas said entry spool has implementations incorporating a maximum available of essentially straight segments, including a single essentially straight segment of said rigid jumper, whereas said essentially straight segments of said rigid jumper are adjacent to said two pipe bends incorporated in said entry spool;

said rigid jumper incorporates an exit spool located at a floater end of said rigid jumper; said exit spool incorporating a maximum available of two or one pipe bends of said rigid jumper that are not incorporated in said entry spool, whereas said exit spool has implementations incorporating a maximum available of essentially straight segments, including a single essentially straight segment, of said rigid jumper, whereas said essentially straight segments of said rigid jumper that are incorporated in said exit spool are adjacent to pipe bends incorporated in said exit spool and are not essentially straight segments of said rigid jumper that are incorporated in said entry spool; said floater end of said rigid jumper being located essentially at a support of said piping system of said floater which is a nearest to said top of said rigid riser, while measuring along said rigid jumper;

said rigid jumper has implementations incorporating an additional pup pipe bend of sustained angle not exceeding 20° that is located essentially in a region of one of the ends of said rigid jumper;

said rigid jumper has implementations incorporating a partial loop, whereas said partial loop is incorporated in said rigid jumper between said entry spool and said exit spool and said partial loop includes all pipe bends and all essentially straight segments available between said entry spool and said exit spool; whereas a sum of all sustained angles of plan shapes of all pipe bends included in said partial loop does not exceed 359°, said plan shapes of all pipe bends included in said partial loop being orthogonal projections of wirelines of said all pipe bends included in said partial loop on a horizontal plane in a floater system of coordinates; whereas wirelines are defined as geometrical loci of geometrical centers of all design orthogonal cross-sections along said rigid jumper, including along subsets of said rigid jumper; said subsets of said rigid jumper including said pipe bends and including said partial loop;

and whereas said rigid jumper provided with said partial loop characterizes with an open plan shape of said partial loop that makes it feasible to install said rigid jumper provided with said partial loop with said rigid riser already installed in place by avoiding interfering with a structure of said rigid riser already installed in place without a need for threading said rigid riser and without a need for threading equipment used to install said rigid riser through an area partly surrounded by segments of said partial loop, said segments of said partial loop comprising pipe bends and comprising essentially straight segments incorporated in said partial loop.

Note: Threading with regard to non-open geometries in the above does not necessarily mean threading offshore hardware or the rigid riser through a closed (spiralflex) coil. It is rather meant as achieving a configuration of being threaded that can be achieved by literally threading the equipment (rigid riser tops, slings, shackles, master links, etc.) through spiralflex coils in a way that resembles threading a line through an eye of a needle. It can also mean for example assembling a spiralflex coil on an installation ramp, in a J-lay tower, etc. or in the water, etc. around the rigid riser or around a sling supporting the weight of a rigid riser while being suspended from a crane. Such an assembly operation could for example involve welding the bends together, using connectors or flanges, etc. around the top of the riser or other equipment. All those and the installation stages following would be very cumbersome and difficult for spiralflex spools, while those difficulties do not exist at all for open SJS spool geometries.

For those SJSs where optional intervention 'Y' fittings are used, the intervention services can be carried out using any established subsea engineering procedures. Intervention services can be alternatively carried out as outlined in this specification. Bending flexibility of novel mini-riser designs disclosed herein can be used for servicing the risers.

Optional intervention 'Y' fittings ('Ys') used with this invention need to be able to sustain static and dynamic loads in the SJS branches of the 'Ys'.

BRIEF DESCRIPTION OF THE DRAWINGS

A selection of multiple implementations of this invention is and its example performance is illustrated on FIGS. 1 through 9.

MODES OF CARRYING OUT THE INVENTION

Figure 1:
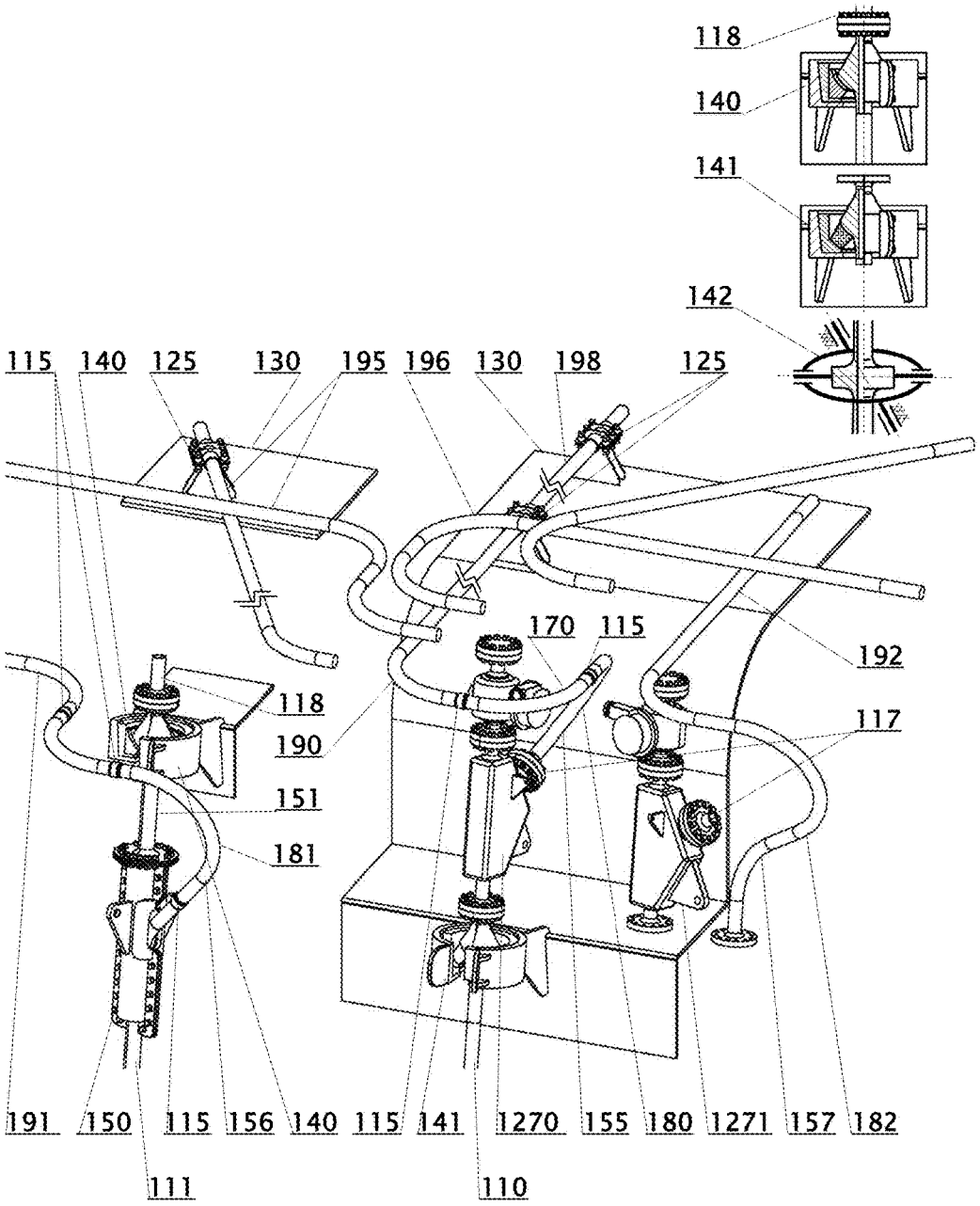
FIG. 1 depicts schematically several SJS hang-off configurations used on a pontoon of a semi-submersible or of a TLP.

Floaters, including floating platforms, ship-shaped vessels and buoys move in up to six degrees of freedom. The definition of the floater is hereby extended to partly or completely submerged structures that can also move in, or near to, or below the surface layer(s) in the ocean. A disconnectable buoy of a turret moored FPSO or FSO is also a submerged structure. Another obvious example of such a submerged structure is a floater tank (or a submerged buoy) of a hybrid riser, from which SCRs and other rigid risers can also be suspended (at least theoretically).

By risers any kind of rigid riser is meant, but specifically rigid catenary risers, any metallic catenary risers, including SCRs and titanium risers of suspended or lazy wave configurations. Flexible hang-off devices according to this invention can be also used with 'U' shaped rigid jumpers and with 'W' shaped rigid lazy wave jumpers suspended from floaters, accordingly, whenever the word riser or abbreviation SCR is used herein, it is understood that rigid catenary jumpers are also included in the 'riser' or 'SCR' category as it is understood herein.

This invention concerns angular motions of top of the risers relative the floaters from which the risers are suspended. This subject is engineered on every offshore floater project and it is well known to those skilled in the art.

This invention is the result of the development of the flexing spool theory of rigid riser hang-offs that this inventor formulated in spring 2014. That theory allows predicting the structural performance of tubular members loaded in combined torsion and bending, and to carry out reasonable estimates of rotational spring constants of devices utilizing pipe flexibility in torsion and in bending.

While disregarding the (submerged) self-weight, hydrodynamic, inertia and end reaction induced loads on SJSs, it is apparent that the effective tension is essentially small along the SJSs. As the first approximation (even at high rigid angle deflection angles) one can assume that infinitesimally short or finite length segments of SJSs that are orthogonal to the plane of the riser deflection see pure torsional load. Those infinitesimally short or finite length segments that are essentially parallel to the plane in which the rigid riser is deflected undergo pure bending. All other segments undergo angular deformations that combine torsional and bending loads, while the combined (torsional+bending) moment is in this approximation tends to be essentially constant along the SJS. A further observation follows that in a circular pipe torsion is (1+v) times more effective than the bending is in accommodating angular deflections of the riser for any segment along the SJS, where v is the Poisson Ratio of the SJS material. The total rotational spring stiffness of the SJS hang-off can be estimated from the formula on the stiffness of a system of springs connected in series. That formula simplifies tremendously once the above observations are included in the algebra, and that is approximately valid in spite of complicated 3-D spool geometries. See one of the priority documents for a pictorial illustration.

The next level of observation is that the platform piping also contributes rotational flexibility to the combined rotational flexibility resulting from the deflections of an SJS. That is because platform piping bends and undergoes torsion beyond the first piping support and beyond other clamp supports on the floater. Whenever the exit end of the exit spool sees pure torsion, the first, and possibly further clamp supports are near to 100% transparent to the torsional load and any corresponding straight lengths of the platform piping should be added to the torsional spring segments of the system of springs connected in series. There is also a similar case with the flexion of the platform piping due to bending, but for those the piping supports are more 'transparent' for specific span lengths selections. The above simple observations can be used to reduce the rotational stiffness of the hang-off and to fine tune its circularity (or the lack of thereof, if desirable), as the azimuth angle of the rotational riser deflection varies. Selecting various materials for constructing different segments of SJSs and of platform piping can be used as a part of the design of the characteristics of SJS flexible hang-offs desired.

Whenever the entire SJS is incorporated directly between the pivot and the floater piping, there is a tendency to a predominant pure bending in the gooseneck and accordingly the shear loads in the SJS pertaining to bending are locally very small, which increases the accuracy of the above approximate method.

It immediately appeared in 2014 that the spiralflex according to Wajnikonis and Leverette is over-engineered, and that the over-engineering involved implies multiple disadvantages, as already highlighted. The development of this invention is the result of the confirmation of the approximate theory of 2014 with large deflection Finite Element Analyses (FEAs). Once confirmed, the approximate combined spool loading theory provided an excellent focusing and pre-screening tool for preliminary and conceptual design of the SJS and platform piping configurations.

In order to design SJSs having compact footprints, like those depicted on most drawings herein, SJSs require for their design solving non-linear equations in the field of 3-D analytical geometry (undergraduate course level). When required, the solutions of the geometrical equations tend to be unique. FEA programs or computer aided design (CAD) programs do not include tools facilitating SJS design.

When using steel, super-duplex, etc., pipe it is feasible to use optional partial loops in spools subject to torsion and bending while transporting fluids and containing pressure. A use of coiled geometries is not necessary with the above materials, a partial loop is sufficient to accommodate the whole range of riser top rotations required up to about 25°.

While using titanium alloys, even a partial loop is not necessary, sufficient flexibility is readily achieved with a curved jumper incorporating only entry and exit spools that connect the riser with the floater piping. Titanium alloys are particularly suitable for this task, and they are the preferred materials for SJSs because of their low modulus of elasticity, high strength and the Poisson Ratio that is slightly higher than that characteristic of steels. Titanium is also corrosion resistant, and allows a use of fatigue curve exponents that are higher than are those used for steels, see OTC 18624. Partial loops can however be used optionally in titanium SJSs in order to further decrease the rotational stiffness of the hang-offs or/and in order to fine tune the hang-off characteristics as they vary with a change of the deflection azimuth angle.

Whenever angular motions of a floater are limited considerably, like for example with TLPs and Spars, it may be feasible to engineer SJSs that do not utilize partial loops, even while using steel alloys or iron based CRAs.

The rotational spring stiffnesses of hang-offs utilizing this invention are considerably lower than are those characteristic of flex joints or titanium TSJs. Furthermore, the deflections angles allowable with SJSs according to this invention are considerably greater than are those achievable while using flex joints or titanium TSJs.

5•OD and occasionally greater bend radii of curvature are used in offshore engineering to ensure bend pigability with so-called intelligent pigs or with other longer pig designs. However, for some pigs also used in the industry 3•OD radii of curvature are sufficient for pigability, and therefore any preset design radii of curvature of bends used with this invention can be used depending on specific pigability requirements. That also includes radii of curvature smaller than 3•OD, like for example 1.5•OD, as well as all other values smaller than 1.5•OD, or greater than 1.5•OD up to and beyond 10•OD, or more if so chosen or required in any particular design according to this invention.

For conservatism and for sake of examples all bends depicted on FIGS. 1 through 7 are 5•OD bends. 5•OD, 3•OD, 1.5•OD, 10•OD or greater or smaller bend radii of curvature are referred to herein for sake of examples only, and accordingly any bend discussed herein or shown on the schematics provided on FIGS. 1 through 8 can have different, smaller or greater radius of curvature.

This invention is explained further by reference to FIGS. 1 through 9.

FIG. 1 depicts schematically SJSs 155, 156, 157 used in riser hang-off configurations installed on a pontoon 130 of a semi-submersible or of a TLP. SJSs 155, 156 and 157 feature entry spools 180, 181 and 182 and exit spools 190, 191 and 192, respectively. No optional partial loops are used in most configurations shown on FIG. 1, except that 90° bend 170 becomes partial loop 170 when optional exit spool 196, or similar is used instead of exit spools 190, 191, 192 or 195. Exit spools 195 and 196 are example optional replacement configurations for exit spools 190, 191 and 192, shown in a way that is meant to indicate that infinitely more implementations of exit spools rather than only spools 190, 191, 192, 195 or 196 shown are feasible and acceptable in designs according to this invention—it is only practical to draw a few examples. Spools 190, 191, 192, 195 or 196 can be configured in any functionally acceptable configurations in order to modify the rotational characteristics of the SJS hang-offs. All the arrangements shown are non-descending, with parts of entry spools and entire exit spools being essentially horizontal in the vessel coordinate system for example only. Non-descending or continuously ascending SJSs are preferred, particularly for many production riser hang-offs, but ascending/descending SJSs according to this invention can be also acceptable depending on requirements of particular projects.

Any of the SJS hang-off configurations shown on FIG. 1 can feature SJSs installed between the pivots and the vessel piping, or they can instead utilize hang-off clamps like hang-off clamp 150. Clamp 150 can utilize optional extension member 151 for connection with the pivot, or it can be attached directly to the pivot assembly. Three pivot assembly types are depicted schematically on FIG. 1. They are mutually exchangeable in designs according to this invention. Other, alternative pivot arrangements not shown can be also used instead, see Wajnikonis and Leverette for more examples. Those shown on the main drawing and on the detail insert are ball joint 140 and flex joint 141 installed in typical receptacle baskets, but any type of structural support, porch or bank can be used instead. Ball joints, flex joints and in most cases their installation receptacles are shown herein mostly with segments of their bodies cut-out for illustration purposes. Gimbal pivot 142 that can replace items 140 and/or 141 is depicted schematically on the insert. All the bends shown are planar 5•OD bends that are welded together, connected together or connected to other equipment using connectors 115 or flanges 117. Note very slim profiles of connectors 115 shown that are those of the preferred type disclosed in PCT/US2016/028033, but any suitable type of flange or connector can be used in the SJSs of the types shown. Optional intervention 'Ys' 1270 and 1271 that can be incorporated in the goosenecks are also shown on FIG. 1.

Spools of platform piping 198 are attached to pontoon 130 of the vessel (platform or other floater) using guide clamps 125 that preferably attach platform piping to the floater in a way allowing free rotations, axial sliding and angular deflections of the pipes clamped. Clamps 125 preferably utilize elastic lining to allow the above movements and to protect the pipe and its coatings from fretting and from other mechanical damage. Flange 118 shown optionally can be used for connection to installation equipment used to install riser 111. Riser 110 can be installed in the same way, which is well known, typical to SCR installations.

Figure 2:
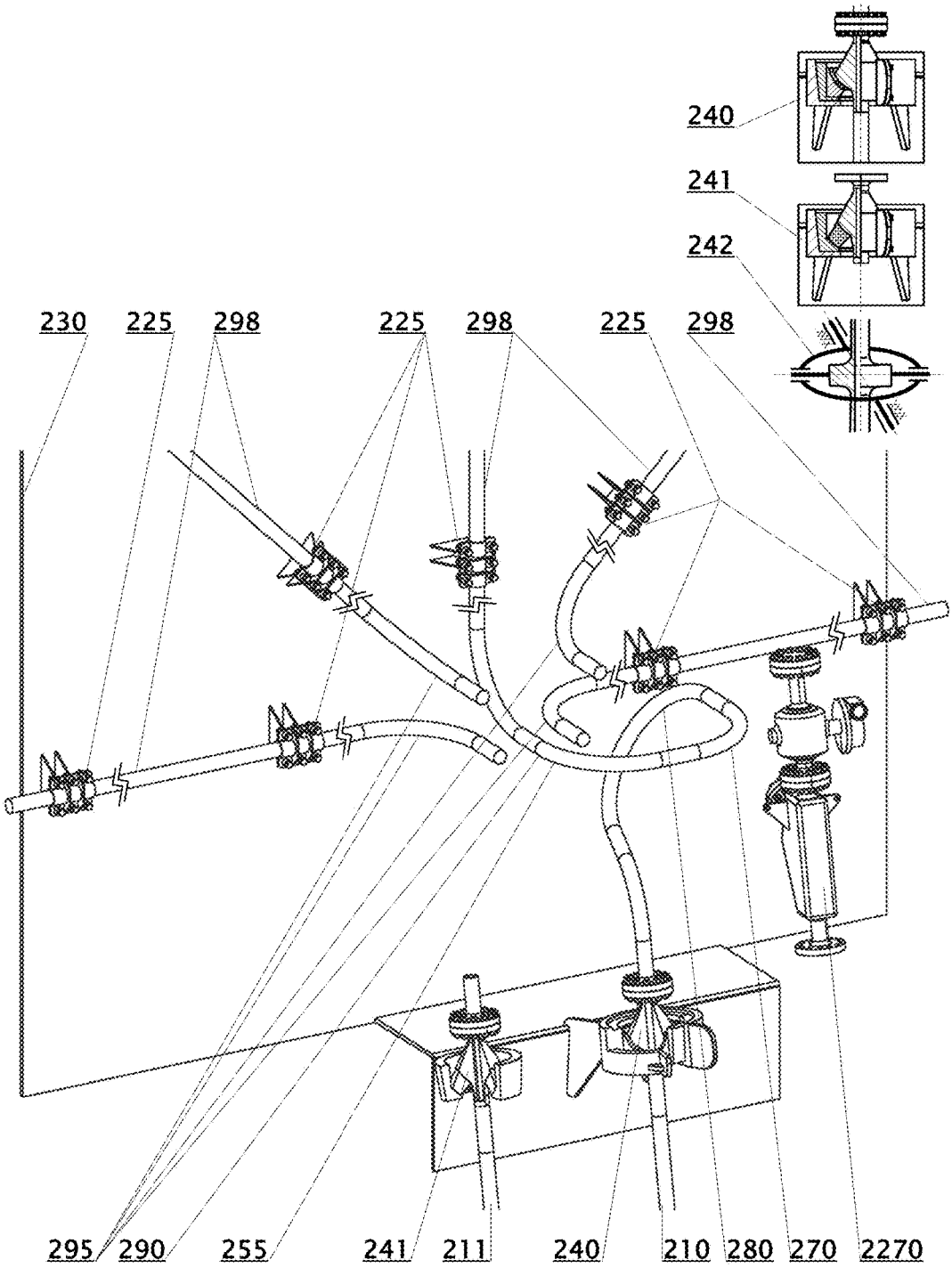
FIG. 2 depicts schematically several SJS hang-off configurations used on a side of a vessel, a pontoon or a column.

FIG. 2 depicts schematically SJS 255 used in riser hang-off configuration installed on side 230 of a vessel, pontoon or a column of a semi-submersible or of a TLP. SJS 255 features entry spool 280 and exit spools 290 or 295. Optional partial loop 270 consists of a 90° bend. Exit spools 295 are example optional replacement configurations for exit spool 290 shown in a way that is meant to indicate that infinitely more implementations of exit spools rather than only spools 290 or 295 shown are feasible and acceptable in designs according to this invention. Spools 290 or 295 can be configured in any functionally acceptable configurations in order to fine tune the rotational characteristics of the SJS hang-offs. All the arrangements shown are non-descending, with parts of entry spools and entire exit spools being essentially horizontal in the vessel coordinate system for example only.

Any of the SJS hang-off configurations shown on FIG. 2 can feature SJSs installed between the pivots and the vessel piping, or they can instead utilize hang-off clamps 150 similarly to an option shown on FIG. 1. Three pivot assembly types are depicted schematically on FIG. 2. They are mutually exchangeable in designs according to this invention. Other, alternative pivot arrangements not shown can be also used instead, see Wajnikonis and Leverette for more examples. Those shown on the main drawing and on the detail insert are ball joint 240 and flex joint 241 installed in standard type receptacle baskets, but any type of structural support, porch or bank can be used instead. Gimbal pivot 242 that can replace items 240 and/or 241 is depicted schematically on the insert. All the bends shown are planar 5•OD bends that are welded together, or optionally connected together or connected to other equipment using connectors 115 or flanges 117, see FIG. 1. The spools shown on FIG. 2 are welded together for sake of an example, which makes it possible to install SJSs like SJS 255 in one piece. Optional intervention 'Y' 2270 that can be incorporated in the gooseneck is also shown on FIG. 2.

Spools of platform piping 298 are attached to floater side 230 using guide clamps 225 that preferably attach platform piping to the floater in a way allowing free rotations, axial sliding and angular deflections of the pipes clamped. Clamps 225 preferably utilize elastic lining to allow the above movements and to protect the pipe and its coatings. Risers 210 and 211 are also shown.

Figure 3:
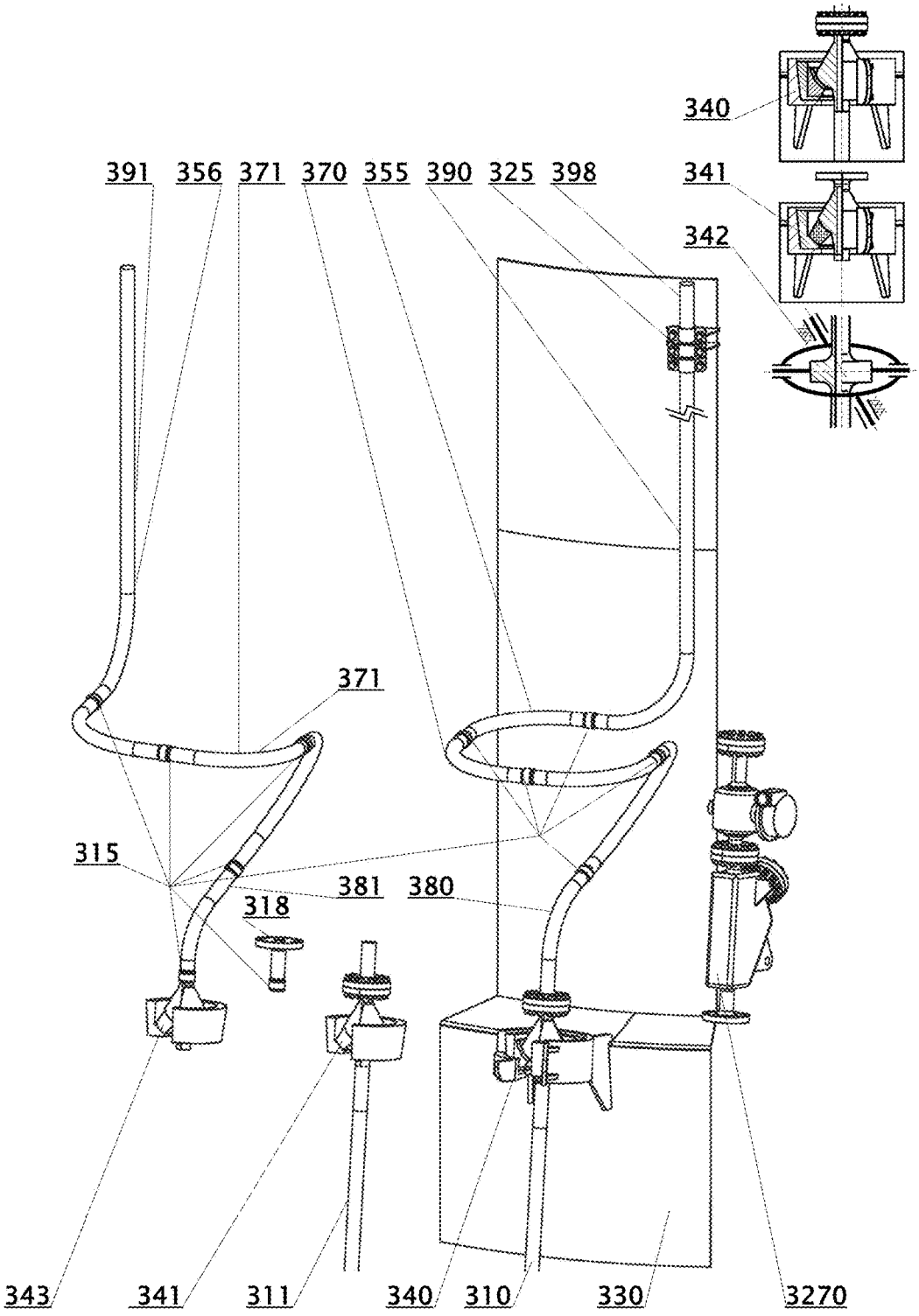
FIGS. 3 and 4 depict schematically several SJS hang-off configurations used on turrets, disconnectable turret buoys or on independent floating or submerged buoys.

FIG. 3 depicts schematically SJSs 355 and 356 used in hang-off configurations installed on turret 330 or on disconnectable turret buoy, floating or submerged buoy all annotated as 330. SJSs 355, 356 feature entry spools 380, 381 and exit spools 390, 391 respectively. SJS 355 is non-descending, partial loop 370 incorporates two 90° bends, while SJS 356 is ascending (upwards slope everywhere along its length relative the floater horizontal). Partial loop 371 incorporates a single close to 90° bend. SJS 356 is an example optional replacement spool for SJS 355, shown in a way that is meant to indicate that infinitely more SJS configurations can be used instead of SJSs 355 and 356. Pivot arrangements 340, 341, 342, 343 or other pivots feasible can be used in the configurations shown and in those implied. SJSs 355 and 356 utilize connectors 315 in multiple locations. In particular entry spool 381 utilizes a connector to join its gooseneck to flex joint 343, which is a recommended option worth considering for all SJSs according to this invention. In such arrangements a compatible connector can be used for attaching lifting equipment for the installation of riser 311, or alternatively optional flange adapter 318 can be used to interface with conventional installation equipment. Following the riser installation optional adapter 318 is removed and pivot arrangement 343 is connected to entry spool 381 using connector 315. Like in the cases of other drawings herein, many SJS implementations according to this invention not shown can be used in the arrangements shown. SJS 355 utilizes ball joint 340 as the pivot, but any of the configurations shown or implied can use any pivoting arrangement feasible, like gimbal 342, universal joint, shackles, chain, etc. Optional intervention 'Y' fitting 3270 can be also used on turrets, disconnectable turret buoys or on independent floating or submerged buoys 330 in any configuration feasible.

All the bends shown on FIG. 3 are planar 5•OD bends that are welded together, connected together or connected to other equipment using connectors 315 or flanges. Spools of platform piping 398 can be attached to turret or other structure relevant 330 using guide clamps 325, preferably of design features already described further above, or it can use other support means depending on the configuration of turret, etc. 330, including for example a passage through turret/buoy skirt or bulkhead. Shielding the SJSs from a current flow can be effected in that way. Riser 310 can be installed in similar way to riser 311, 110, 111, 210 or 211, which is well known, typical to SCR installations.

Figure 4:
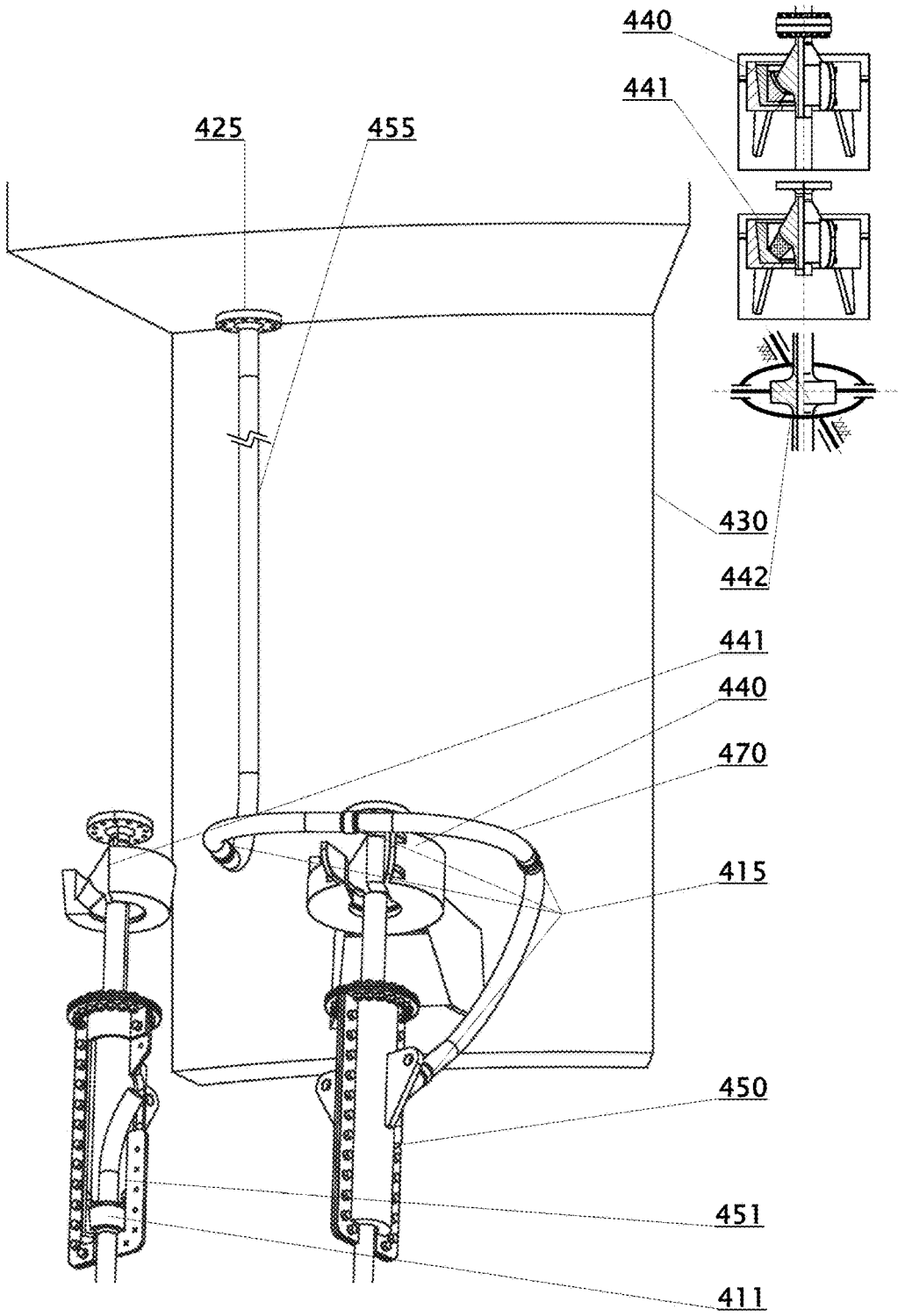

FIG. 4 depicts schematically SJS 455 used in a riser hang-off configuration installed on a turret 430 or on disconnectable turret buoy, floating or submerged buoy all annotated as 430. SJS 455 features a single bend partial loop 470 and it is suspended from ball joint 440 using hang-off clamp 450. Flex joint pivot arrangement 441 is also shown with hang-off clamp 451 having part of its shell removed to show details of its typical interaction with top of riser 411. Pivot arrangements 440, 441, can be replaced by gimbal 442 or by other pivots feasible.

All the bends shown on FIG. 4 are planar 5•OD bends that are welded together, connected together or connected to other equipment using optional connectors 415 or flanges. Spools of turret, etc. piping can be attached to turret or other structure relevant 430 using guide clamps or bulkhead/wall/skirt passage arrangements 425.

Figure 5:
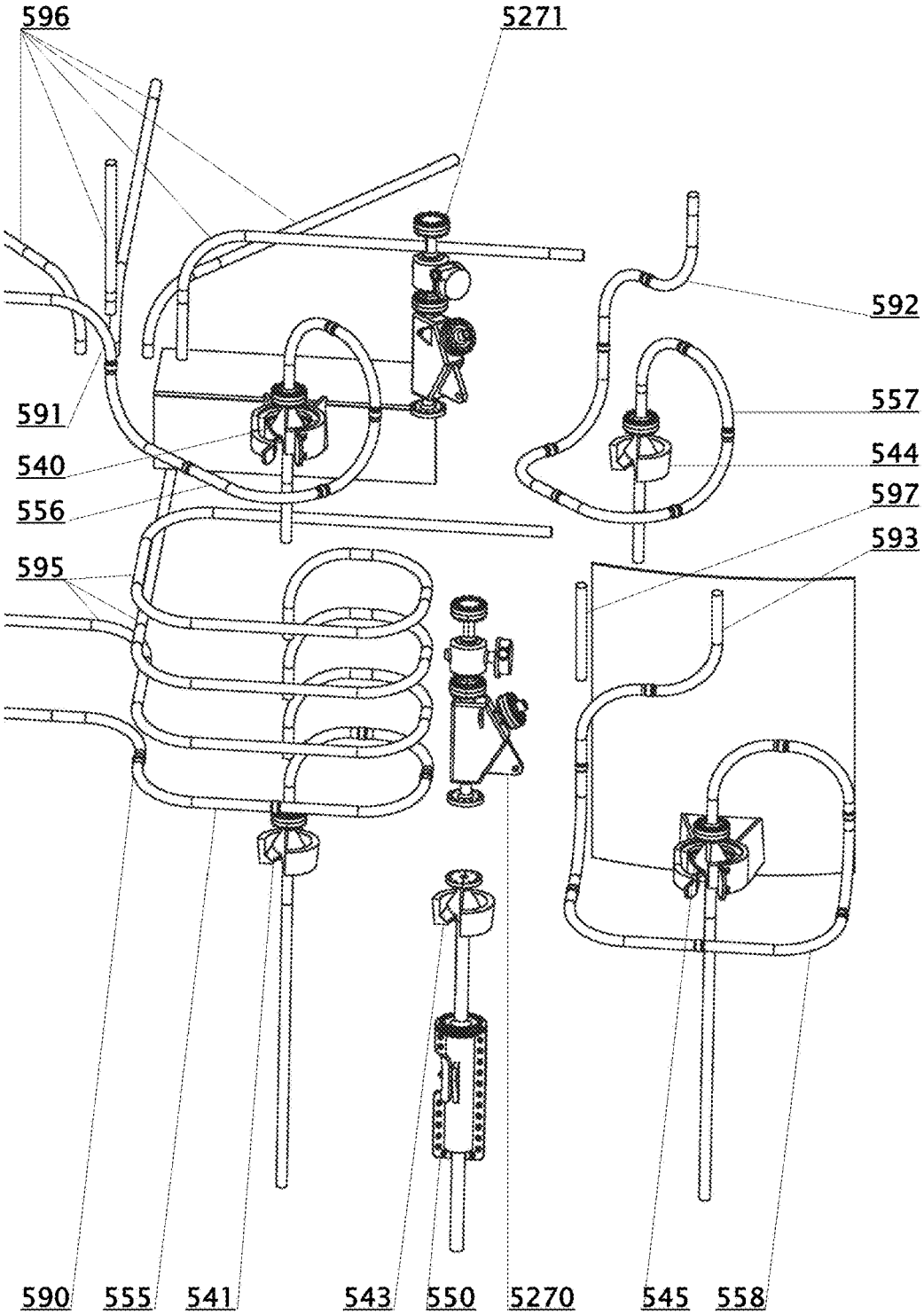
FIGS. 5, 6 and 7 depict schematically multiple SJS hang-off configurations used on various offshore structures.

FIG. 5 depicts schematically SJSs 555, 556, 557 and 558 used in riser hang-off configurations, featuring multiple geometrical arrangements of exit spools 590, 591, 592, 593, 595, 596 and 597 used on various floater structures. Unlike all the SJS geometries shown on FIGS. 1 through 4 and 6 through 8, SJSs 555, 556, 557 and 558 use only 90° bends in simple wireline geometries that do not require solving non-linear equations in the field of basic analytical geometry as a part of their design. As the result SJSs 555, 556, 557 and 558 have larger footprints than have other, more compact SJSs depicted on other figures that require for their design mathematical preprocessing. Relatively large footprints of SJSs 555, 556, 557 and 558 may not be a disadvantage when SJSs use as materials steel or other iron based alloys, rather than titanium alloys. An advantage of SJSs 555, 556, 557 and 558 is that all those spools are arranged on the outboard side of the riser hang-off, and accordingly the bending load on the riser receptacle and on the floater structure caused by the tension of the riser can be minimized. SJS footprints may result in a greater horizontal separation between hang-offs, which has a beneficial effect on line susceptibility to clashing. When that separation is too big, riser hang-offs can be staggered to reduce their separation.

SJS 555 and its variations using exit spools 595, or similar are non-descending. SJSs 556, 557 and 558 feature mixed ascending/descending configurations. The pivoting arrangements used are exchangeable between ball joints 540, 545 flex joints 541, 543, 544, gimbals 142, 242, 342, 442 and other types of pivoting arrangements not shown. All SJSs shown can optionally utilize hang-off clamps 550 and most can utilize optional intervention 'Ys' 5270, 5271, subject to the availability of essentially straight access above the 'Ys'.

Figure 6:
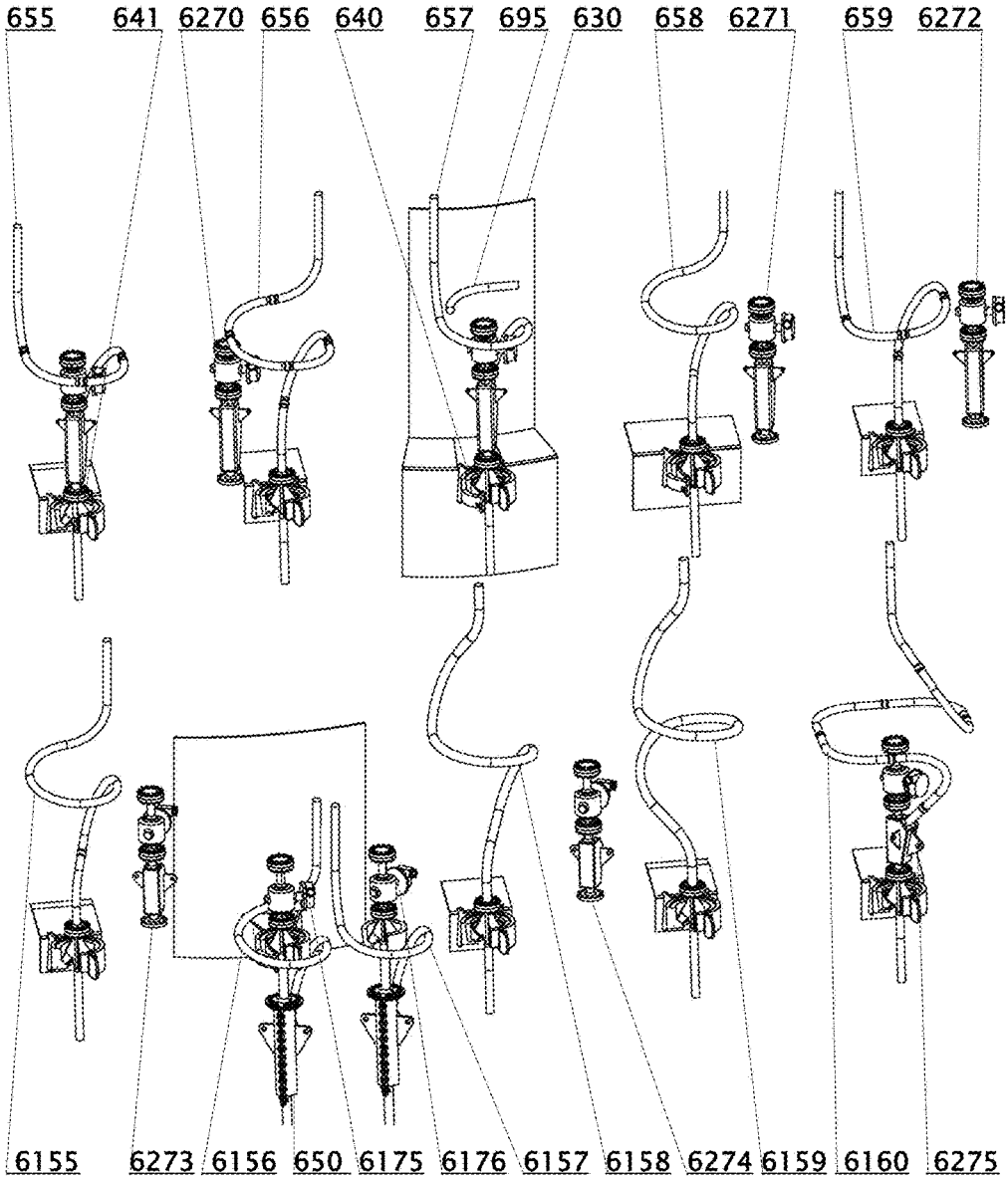

FIG. 6 depicts schematically SJS 655 through 659 and 6155 through 6160 used in riser hang-off configurations on various types of floaters. SJSs shown can be used on any kind of floaters discussed herein, and on turrets, disconnectable buoys, floating buoys or submerged buoys 630.

SJSs 655, 656 and 659 use very short straight segments between bends, just long enough to use connectors. Non-descending SJSs 655, 656 differ with the number of 90° bends incorporated in their partial loops—one for SJS 655 and two for SJS 656. SJSs 655, 656, 657, 658, 6155, 6156 and 6157 are ascending. SJS 659 features an ascending/descending configuration with a part of its entry spool, the one bend partial loop and a part of its exit spool having negative slope angle in the floater system of coordinates. SJSs 6158, 6159 and 6160 feature ascending/descending geometries, whereas the top parts of exit spools shown are arranged along lines tangent to their risers corresponding at the pivot locations. Such configurations can be rotated around the common riser—end of exit spool axes to arbitrary azimuth angles for more convenient design. In fact the essentially ascending/descending designs of SJS 6158 and 6159 feature considerable reductions of the absolute values of the negative slopes and of the lengths of the negatively sloped segments because of such rotations in comparison with their original design orientation (not shown) that was similar to the entry spool orientation of SJS 6160. SJSs 6156 and 6157 demonstrate that all the SJSs shown on FIG. 6 can be optionally suspended with help of hang-off clamps 650. SJS 6160 features considerably larger footprint than do the other SJSs featured on FIG. 6, and also on FIGS. 1 through 5 and on FIG. 8.

SJSs 657, 658, 6155, 6156, 6157, 6158 and 6159 feature the minimum footprints feasible while utilizing 5•OD bends—they have no straight segments in the partial loops, where applicable or between the entry spool, the partial loop and the exit spool, where applicable. SJSs 6158 and 6159 use slightly bigger outside diameter than do all the other SJSs featured herein and their dimensions are proportionally bigger. Exit spool 695 shows an alternative exit spool configuration that is one of exit spool configurations feasible with most SJSs shown on FIG. 6.

Optional intervention 'Ys' 6270, 6271, 6272, 6273, 6274 and 6275 depicted demonstrate that the use of intervention 'Ys' may be feasible for all the configurations herein that do not utilize hang-off clamps 650. For the latter configurations it can be in some cases feasible to incorporate a part of intervention 'Y' fittings with the diverter inside hang-off clamps 650 and to place service valve unit 6175, 6176 on top of the pivot arrangements. Ball joint pivots 640, flex joint pivots 641, gimbal pivots 142, 242, 342, 442 and many other pivot arrangements can be used to replace the pivot arrangements depicted on FIG. 6.

Figure 7:
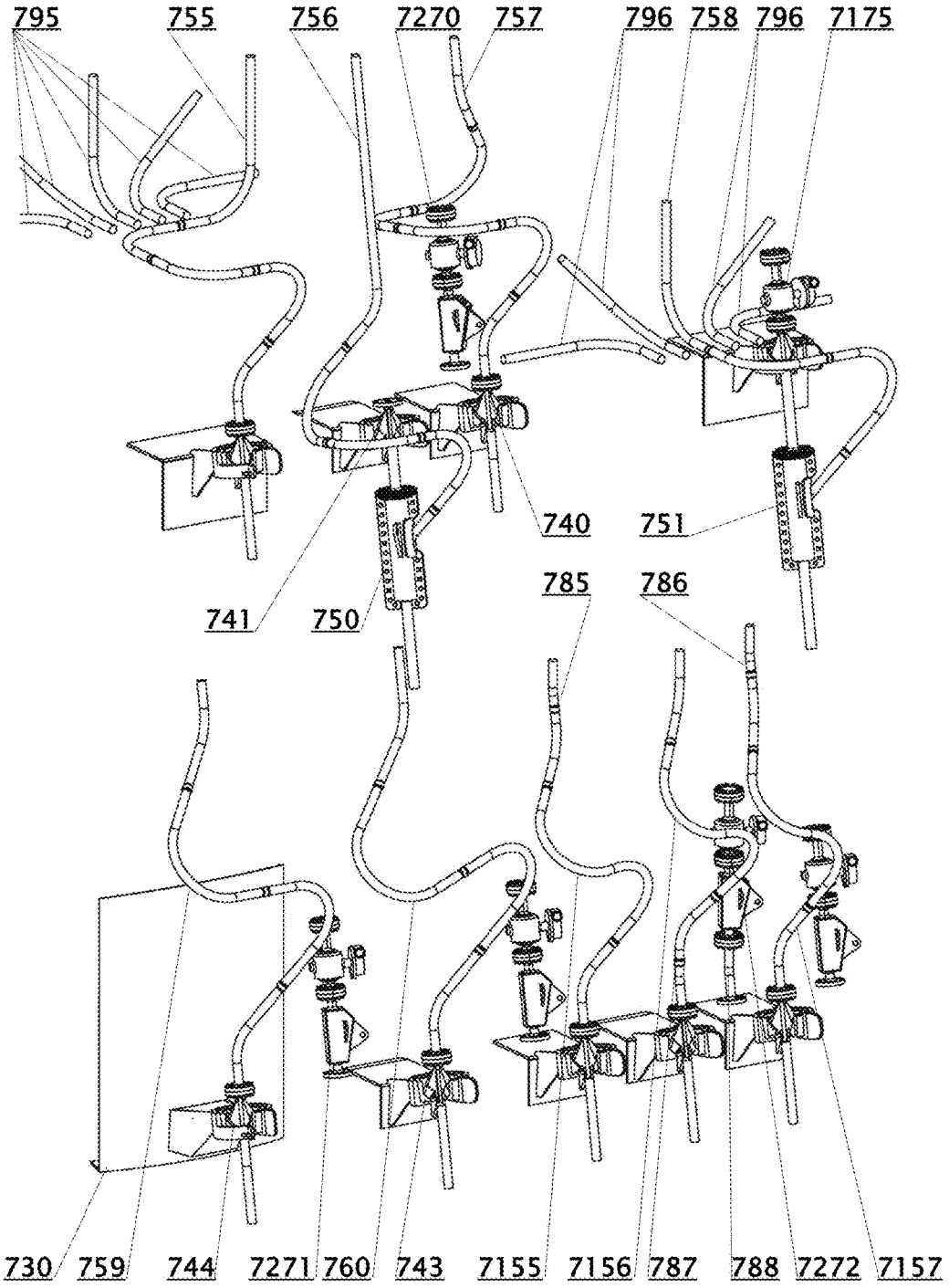

FIG. 7 depicts schematically SJSs 755 through 760 and 7155 through 7157 used in riser hang-off configurations on various types of floaters. SJSs shown can be used on any kind of floaters discussed herein, and on turrets, disconnectable buoys, floating buoys or submerged buoys 730.

SJSs 755, 758, 759 and 7156 have non-descending geometries. SJS 7157 has continuously ascending geometry. SJSs 756, 757, 760 and 7155 have ascending/descending geometries. SJSs 758, 759, 760, 7155, 7156 and 7157 have no bends or straight segments, i.e. no partial loops, between the entry and the exit spools.

Exit spools 795, 796 are shown in a manner meant to highlight that infinitely many exit spool geometries are feasible in all SJS configurations according to this invention. All SJS geometries according to this invention can be used with riser hang-off clamps 750, 751. All SJS geometries according to this invention that do not feature riser hang-off clamps can be also used with optional intervention 'Ys' 7270, 7271, 7272. Optional intervention 'Y' 7272 may in some cases feature a change in the inclination of the service segment to the vertical while utilizing pup bend 788. The entire SJS assemblies may also utilize a similar arrangement using pup bend 787. In most design cases, it is however preferable to use for interventions a direct, straight servicing access to the riser. Also, when optional intervention 'Y' is not in place it is preferable to incorporate all the change in the SJS orientation in the design of the usual two bends of the entry spools, rather than to use a pup bend 787. Redirecting pup bends 785, 786 can be also placed near the ends of exit spools. In some cases it can be feasible to incorporate parts of intervention 'Y' fittings with the diverter inside hang-off clamps 751 and to place service valve units 7175 on top of the pivot arrangements. Ball joint pivots 740, 744, flex joint pivots 741, 743, gimbal pivots 142, 242, 342, 442 and many other pivot arrangements are can be used to replace the pivot arrangements depicted on FIG. 7.

Figure 8:
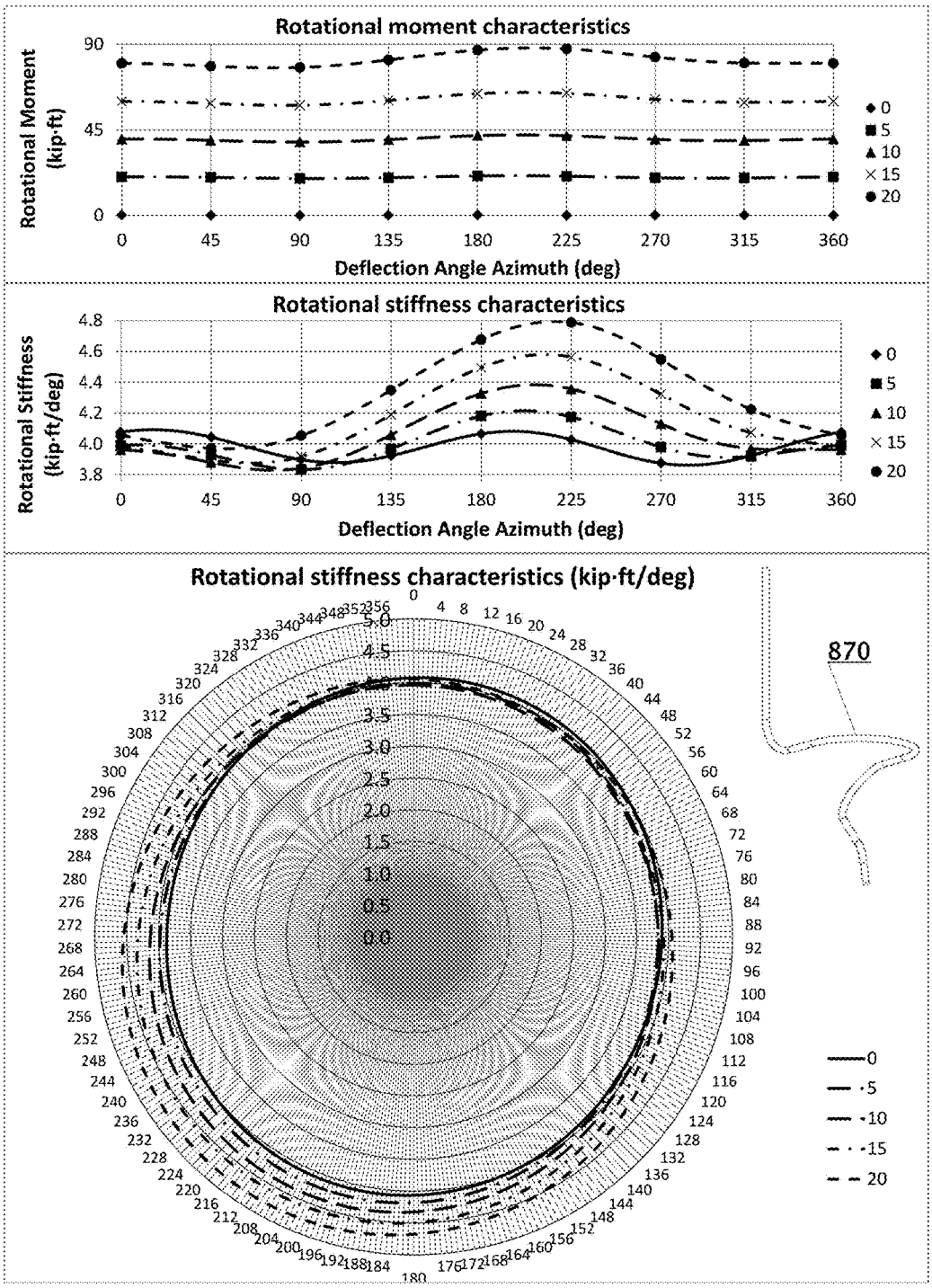
FIG. 8 depicts an example SJS shape together with example plots of static deflection characteristics of a riser hang-off utilizing that SJS.

FIG. 8 depicts an example SJS shape together with example plots of static deflection characteristics of a riser hang-off utilizing the said SJS. The SJS featured was made of titanium alloy, it had the outside diameter OD=8.625 in (219.1 mm) and wall thickness WT=1.25 in (31.8 mm). The SJS modeled was designed for the design pressure of the order of 20,000 psi (1,378 bar, with only initial wall thickness calculations carried out, i.e. no correction for pipe fatigue) and it used a non-descending SJS configuration similar to many configurations featured on FIGS. 1 through 7. 180° bend 870 had bend radius of 5 ft (1.524 m), which resulted in the bend radius to OD ratio of 6.96. The remaining bends modeled were 5•OD bends. The design riser tension in ultra deepwater was 1,400 kip=6,228 kN.

The example static characteristics shown were computed following a large deflection FEA analysis of a preliminary character using shell elements to model the SJS. Because the greatest design deflections occur in survival design conditions (example: 100 years hurricane wind and wave with one mooring line broken) with no product flow and the system depressurized, no pressure load was used in any load-case examined. The characteristics plotted on FIG. 8 use the US Customary Units, 1 kip·ft≈1.356 kN·m and 1 kip·ft/deg≈1.356 kN·m/deg. The bending moments plotted are at the ideal pivot location, so are the rotational moment stiffnesses. These values are plotted as functions of the azimuth angles of the planes in which the riser top was deflected. The Cartesian and 'radar' plots of the rotational stiffness are included. The azimuth angles of the riser deflections were measured in the following way: azimuth angles 0° for the outboard in-plane (IP) riser deflections, 180° for the inboard IP deflections; 90° and 270° for the riser out-of-plane (OOP) deflections, 90° to the right on all drawings herein and 270° for the opposite OOP deflections. FEA simulations were carried out at 45° azimuth angle intervals and at 5° increments of the deflection angles. Those resulted in the discrete results plotted. The continuous curves plotted were interpolated between the discrete values using the Discrete Fourier Series (DFS) and plotted on the plots herein with 1° increments. The values plotted are only those in the typical project range of deflection angle variation up to 20°, but the simulations were carried out for all the azimuth angles up to the maximum deflection angles of 60°, because the preliminary calculations using the approximate SJS deflection theory predicted low SJS stresses at 20° deflections. Obviously, with only preliminary FEA analysis final conclusions cannot be made for very large deflection angles, but it can be mentioned that even at 60° deflection the allowable maximum Huber-von Mises equivalent stresses of 110 ksi (758.4 $MN/m^2$) were not reached. For ultimate loadcases design codes allow the equivalent stress to reach the specified minimum yield stress (SMYS) of the material (design factor 1.0). Even bearing in mind the initial character of this calculation it can be concluded that simple SJS configurations in titanium can accept at a very economical cost deflection angles considerably greater than those possible with titanium TSJs or with flex joints. That conclusion implies that for example SCR risers may become feasible for use in considerably shallower water than they are at present, and that HPHT catenary riser systems that are at present impossible with flexible risers can now become feasible with a use of SCRs. Similarly, SCRs and subsea wells can now replace some dry tree wells systems.

It is noted that in the so called 'fatigue range' of the deflection angles (less than 5° riser deflections) the example SJS system is linear and the rotational stiffness characteristics are practically circular, and in both cases nearly so up to the 20° deflection angles. TSJs rotational characteristics are considerably non-linear at high deflection angles and flex joint characteristics are non-linear. Optimizing the SJS configuration and the floater piping design (neither of which had been attempted at this stage) cannot make worse the results presented that are very good, but there may still be room for additional improvement. The initial omnidirectional rotational stiffness estimate from the approximate theory developed was for this example 5.3 kip·ft/deg≈7.2 kN·m/deg.

Let's now compare the SJS riser hang-off stiffnesses computed with those pertaining to a titanium TSJ designed for the same design pressure, tension and the maximum deflection angle of 20°. Only linear TSJ calculations were carried out for an approximation of the tapered shape (accurate formulae or methodology other than the FEA does not exist), and the approximate calculations predicted the TSJ rotational stiffness of the order of 700 kip·ft/deg (949 kN·m/deg). Taking a conservative 5 kip·ft/deg for an example SJS riser hang-off stiffness, we get 140 times smaller static and dynamic bending stresses for the example SJS riser hang-off than are those pertaining to a comparable titanium TSJ. While using Det Norske Veritas (DnV) fatigue curve exponent of 3.0 that difference would give 140^3=2,744,000 times longer bending fatigue life for the system according to this invention than that in the only other system known to be feasible for the design conditions given. Bending fatigue is the most pertinent failure mode of SCRs, and that near the SCR top is often the worst. For the old American Petroleum Institute (API) fatigue curve API RP 2A X', according to which many SCRs installed in the GoM and elsewhere were designed, the fatigue curve exponent is 3.74 which would result in even higher 140^3.74 i.e. more than 106 million times longer bending fatigue life of the SCR using the SJS.

For the design pressure given a flex joint cannot be built at present and not many sets of published rotational stiffness references are known to this applicant. Using the data known for a design pressure of 10,000 psi, SCR OD=8.625 in an approximate rotational stiffness values can be expected around 30 kip·ft/deg. For similar systems one can expect at least 10 fold improvement in bending stresses, i.e 1,000 improvement in bending stress fatigue life with the DnV fatigue curve, and 10^3.74=5,495 times improvement with the old API X' curve. It is noted that the SJS hang-of does nothing for other failure modes like for example the axial fatigue load. The results presented on the example included are typical for SJS hang-offs according to this invention, but actual numbers vary depending on SJS and floater piping configurations.

It is noted that the rotational characteristics of SJS rigid riser hang-offs are independent on riser tension, which is one of many advantages of this invention. Rotational stiffnesses of titanium TSJs and of flex joints are strongly dependent on riser tension—the greater that tension the stronger and the stiffer designs of TSJs and flex joints result. With smaller riser design tension (less deep water) the results of the above approximate comparisons would have been less extreme, but the designs according to this invention would perform consistently better. The main reason is that in the designs used offshore to date the bending loads are imposed on components that deal simultaneously with large riser tensions and bending, disadvantages which the SJS hang-offs cure completely.

FIGS. 1 through 8 demonstrate that in addition to new installations it is possible to retrofit many SJS systems to replace for example failed flex joints. The above example results show that the replacement of a flex joint with an SJS system according to this invention would decrease the fatigue loading of the SCR throughout the remaining design life of the riser. That should be also possible with a faster equipment replacement time scale (less production lost) and at a lower replacement equipment cost. For new or existing titanium TSJs the fatigue and economic benefits are even greater.

Figure 9:
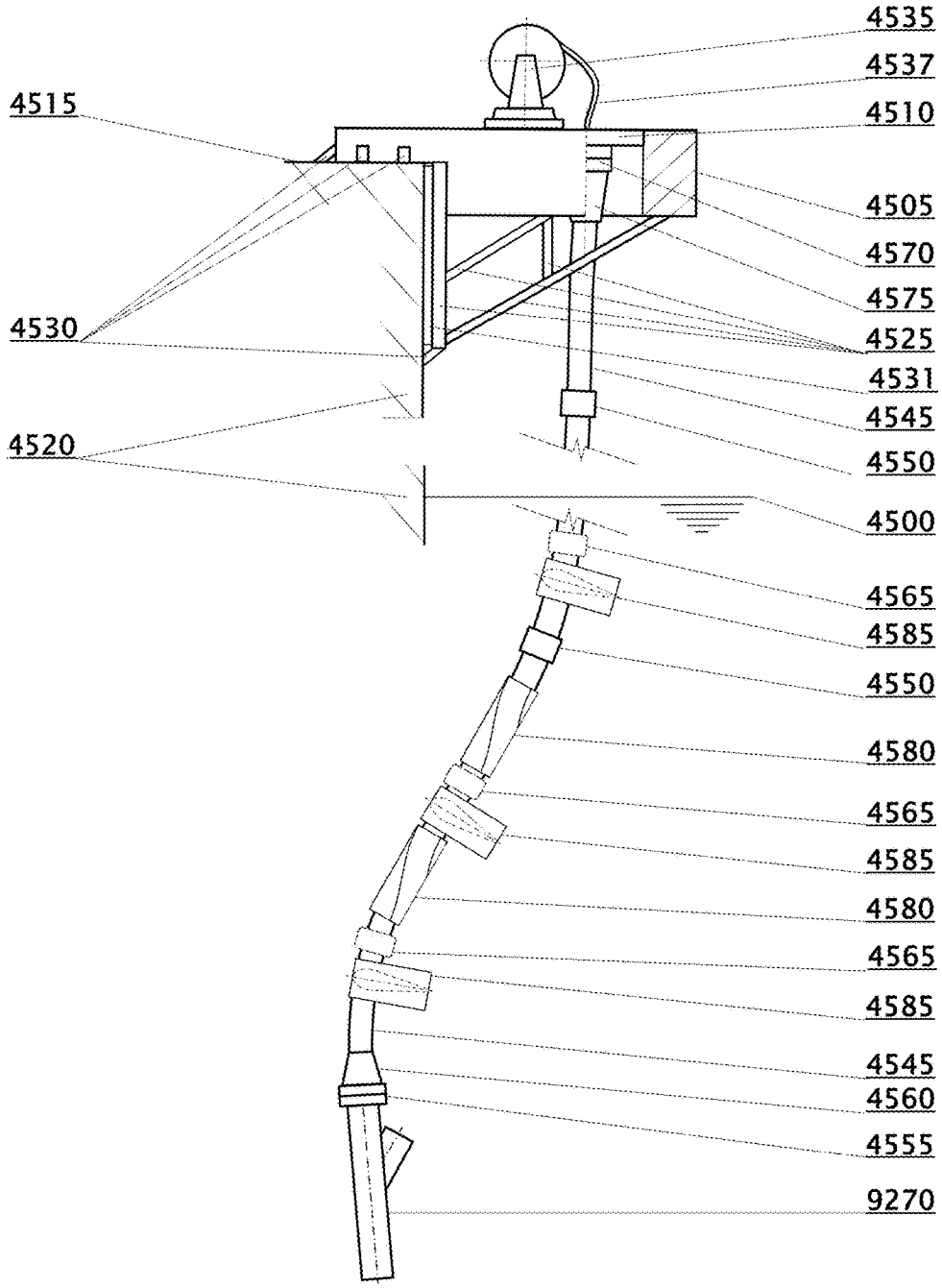
FIG. 9 depicts schematically a configuration of a novel mini-riser system suggested for coiled tubing or wireline interventions into risers for use with Intervention 'Ys'.

FIG. 9 shows schematically an optional configuration of SCR servicing equipment that can be used during coiled tubing or wireline interventions.

Optional intervention 'Y' fitting 9270 is shown schematically on FIG. 9, the SCR, the riser porch and the platform piping or SJS are omitted for clarity. Sea Water Level (SWL) 4500 is shown schematically on FIG. 9.

Catenary riser (SCR, flexible riser, etc.) intervention service unit 4505 is mounted directly or indirectly in a region of deck 4515 or on deck 4515 of vessel 4520 and it is optionally supported on the vessel side or on other structure structurally associated with vessel 4520. The vessel can be the production platform supporting the catenary riser to be serviced, like a semisubmersible, TLP, Spar, etc., an FPSO, etc., an auxiliary support/servicing vessel or a barge stationary in the vicinity of the production vessel. The production and the auxiliary/servicing vessel may or may not be moored to each other. Dynamic positioning can be used.

Catenary riser intervention service unit 4505 is represented on FIG. 9 schematically, structural details of its construction are typical and they can be specified for any particular sets of functional requirements and design loads by anybody skilled in the art.

Vessel (platform) side 4520 is also represented schematically on FIG. 9. Catenary riser intervention service unit 4505 has its geometrical configuration, structural design and structural supports customized in each installation case to be compatible with that of vessel 4520. In case of 'portable' generic intervention service unit 4505, specific shape and structural support modifications would typically be made in order to customize the design and the geometry of intervention service unit 4505 for specific catenary risers (SCRs, flexible risers, etc.) and for use at any specific installation location on a vessel. Structural details of such modifications are typical and they can be specified for any particular sets of functional requirements and design loads by anybody skilled in the art. Engineering standards, like for example API RP 2A, and specifications used must be complied with at all times.

Catenary riser intervention service unit 4505 can be dedicated to servicing a particular SCR or a group of SCRs, or it can be generic, portable, designed for general use with various catenary risers. The SCRs serviced can be provided with flexible SJS hang-offs according to this invention, they can be used on traditional SCRs supported with flex joints or TSJs, or they can be flexible risers (bonded or unbonded).

Catenary riser intervention service unit 4505 depicted schematically on FIG. 9 is mounted on a vessel using supporting structure 4525 of arbitrary design and welded or otherwise attached directly or indirectly to a deck of vessel 4515 and to vessel side 4520 or to other structure associated structurally with vessel 4520 using optional brackets 4530. Instead of a side of the vessel, the servicing equipment can be also located in a moonpool of vessel 4520 or in its general area. Supporting structures such as 4525 and welding brackets such as 4530 are typical items used offshore and principles of their design are well known to those skilled in the art. Optional bearing pad(s) 4531 can be used. Supporting structures such as 4525 and welding brackets such as 4530 are designed to adequately interact with the vessel structure, including its frames, stiffeners, plating, etc. If necessary optional strengthening plates, etc. (including gusset plates) can be welded to the vessel deck and/or side and/or inside the vessel structure. Additional, optional strengthening members can be added as well. Supporting structure 4525 can be attached to any vessel deck, at a general area of any vessel deck or to any part of the vessel structure, as convenient for the intervention operations. The design needs to take into account the safety of all operations, the shape to be assumed by mini-riser 4545 during the intervention operations, the ease of installation of all intervention equipment, crane access, handling equipment and functional considerations, etc.

Coiled tubing 4537 or wireline (also 4537, not shown) is stored and deployed from storage/deployment package 4535. Package 4535 incorporates all the necessary servicing equipment that is not represented in detail on FIG. 9. That equipment may involve an injector, a lubricator (whether or not deployed above or below the sea surface), the coiled tubing reel, all the electrical, mechanical, hydraulic, etc. power units, measuring, monitoring and control equipment, etc. Those will be deployed on decks of vessel 4520 or on other barges or vessels as practicable. Mini servicing riser 4545 used for interventions is suspended from servicing deck or servicing table 4510. Mini riser 4545 can be made up and run using connectors 4550 or it can be made of flexible pipe and deployed from a reel, in cases where the design conditions allow that. The mini riser joint making up equipment (if installed at all, it may be optional), optional flexible deployment reel equipment and all other hardware required are omitted from this schematic drawing for simplicity. The running of the mini-riser can be also carried out from a platform dry tree moonpool and 'keel-hauled' outboard in an essentially vertical configuration for installation in place. If available it can be also run from a drilling vessel, a J-lay tower or a portable drilling rig. Whether or not the installation opportunities highlighted above are or are not readily available, other and often more economical mini-riser installation arrangements (see further below) can be used instead.

Intervention operation described herein can be carried out using existing intervention 'Y' fitting 9270, or intervention 'Y' can be retrofitted on any installation originally constructed without it. Retrofitting of intervention 'Y' fitting 9270 must be carried out consistently with widely used repair or/and equipment upgrade good practice and procedures that are obvious to anybody skilled in the art.

In particular, before any existing spool is removed:

- the line must be depressurized,
- internal fluids must be removed from the platform piping and at least the top segments of the riser,
- the disassembly area must be internally separated with effective separation plug or plugs;
- the piping and the riser must be scrapped and internally cleaned;
- external areas must be cleaned;
- etc., consistently with best engineering and subsea operation practice, legal requirements, engineering standards and specifications approved by the Company and Classification Societies, as it is well known to those skilled in the art.

After any interfering platform piping or SJS entry spool segments are removed, the catenary riser flange (typically above a flex joint, TSJ or flexible riser hang-off) is prepared to accept optional intervention 'Y' fitting 9270, or in a case there is no plan to retrofit one, bottom fitting 4560 of mini servicing riser 4545 can be installed directly on top of the catenary riser flange (typically above a flex joint, TSJ or flexible SJS riser hang-off, not shown).

Subsequently a new shortened piping spool can be connected between intervention 'Y' fitting 9270 and the platform piping. Whenever there is no plans to use an optional intervention 'Y' fitting 9270, the coiled tubing or wireline servicing operations can be carried out and after those are completed, and the replacement piping spool or the original spool removed for the servicing operation can be reinstalled.

In a case existing optional intervention 'Y' fitting 9270, as installed, is structurally inadequate to support design loads on the intervention equipment, an optional support clamp (not shown for clarity) can be installed between the intervention 'Y' fitting at the general area of the low end of the mini riser. The optional support clamp can be attached directly to the vessel structure, the vessel side included, it can utilize the riser porch or riser bank for support, etc. In cases where there may be difficulties in designing conventional type of a support, a cradle like support can be used. A cradle like support can utilize a configuration of one, two, three, four or more, etc. strengthening legs resulting in monopod, bipod, tripod, or four or more strengthening legs, etc., whereas the legs can be straight or curved legs, optional strengthening members can be added, etc. Support structures like those described above can be used on traditional installations of catenary risers including SCR installations utilizing SCR types of flex joints and TSJs, where intervention 'Y' fittings are designed as fixed relative the vessel structure. Any known attachment means can be used where acceptable as required with the supporting structure or structures. Those may include clamping, bolting attachments, thermite welding, helium or argon shield welding, laser beam welding, hyperbaric welding, friction welding, etc. For simplicity new intervention 'Y' fitting installations can be optionally fitted with the supporting structures or they can preferably be designed to sustain all design loads without a need for use of optional support structure(s).

In cases where flexible SCR hang-off featuring SJS(s) according to this invention is used intervention 'Y' fitting 9270 is fixed to the SCR and it undergoes rotational deflections together with the top of the SCR. In such installations intervention 'Y' fitting must be designed to sustain full design loads imposed on the intervention equipment, or the 'vessel side' ends of the supporting cradle, including monopods, bipods, tripods, four or more leg structures, etc. must be fixed, directly or indirectly, to the SCR flange and rotate with the SCR tops, as the SCR deflects relative the vessel structure.

It is obvious to anybody skilled in the art that intervention 'Y' fitting does not need to be designed for the full survival range of rotational deflections, for which the hang-off is designed. In a case a tropical cyclone (hurricane) or other storm passage, extreme loop current event passage, etc. is expected, etc. mini servicing riser 4545 would be disconnected from the intervention 'Y' fitting, etc., and all the equipment secured. In such conditions mini servicing riser 4545 could be also optionally disconnected from its service unit 4505 as required. It can be subsequently retrieved on deck of the vessel or platform, a support vessel, etc., it can be wet stored on the seabed, fitted with additional floatation on one end and anchored to the seabed or moored to other subsea equipment and stored at a safe water depth until the tropical cyclone or other condition, etc. has passed.

The design shape for mini servicing riser 4545 to assume should be as direct and straight as possible, but in general a gentle 'S' shape may be unavoidable, as shown on FIG. 9. The top segments of SCRs are generally inclined at various angles to the vertical (often close to 10°), but flexible risers can be inclined to the vertical at both larger and smaller angles. Mini servicing riser 4545 should be as closely aligned with the riser axis as possible, which will often favor a use of pre-bent lower joint or joints. A use of such pre-bend joints is one of the reasons for designing mini servicing riser 4545 for small effective tensions, which is recommended where feasible (see further below).

Mini servicing riser 4545 would preferably be lead outboard of all the vessel structure, vessel piping, etc., but exceptions from that recommendation are by all means acceptable. For example a part of the mini riser can be lead inside a truss structure of a truss Spar, inside some piping, etc. Where that is the case, the entire mini servicing riser may be 'threaded' along its installation path required during the installation operation, or it can be installed in segments. In the latter case some connectors 4550 may be made-up after all segments of mini riser 4545 have been located essentially along their desired installation path.

Connectors 4550 can be of any type convenient. Simple threaded 'drill-pipe' like connectors can be used, Merlin™ connectors or their third party competitors, flanged connections, connectors with mating sides clamped together, collet connectors, etc. can be used, as functionally acceptable.

In a case any curved or straight segment(s) of mini riser 4545 come into a proximity to the vessel structure, to any piping, I-Tubes, etc. a use of temporary distance clamping may be recommended in order to prevent rubbing or clashing. It may be acceptable to use (a) light weight provisional type(s) of clamp(s) for that purpose, if acceptable according to Company guidelines and standard engineering practice. Optionally the temporary distance clamping arrangement may have compliant characteristics. It may be acceptable to use elastomeric material(s), fiber reinforced or not reinforced plastic materials to build such temporary clamp(s), wood for components loaded in compression only, high strength webbing straps (like those made off aramid fibers, ultra high molecular weight polyethylene like Spectra, Amsteel, etc.) for attachments, etc. It is recommended that in cases where webbing, fiber ropes, etc. is (are) used for attachment, such attachment provisions should include independent components at least doubled for redundancy. For example a temporary clamping arrangement should include at least two independent webbing sets for the attachment to the mini-riser, two independent webbing sets for the attachment to the vessel structural element and two independent webbing, steel cable, etc. sets wound around, in a 'figure eight' or equivalent temporarily clamping directly the mini riser and the vessel structural element in the area of the temporary clamp. The webbing or other arrangement may be optionally designed and calibrated for automatic disconnection or rapture in a case of an accidental overload. Calibrated 'weak link(s)' can be used for that purpose. It is understood here, that if acceptable at all, such temporary clamp(s) would not carry any important structural loads; they would be essentially used as distance spacers, or similar.

In a case an intervention is carried out with a riser or a subsea pipeline blocked internally, all the preparation operations including pigging must be safely carried out from the top end, as if the riser system were not piggable. For safety reasons all the upstream pressures should be blead before the intervention operations or extra secure safety plugs must be installed internally in order to safely separate any possibly pressurized segments of riser/flowline system.

An economical way to install mini-riser 4545 is to assemble the mini-riser on deck of a small barge or support vessel. Mini riser 4545 can be provided with additional buoyancy, and launched from deck in the S-lay mode. Davit-lift like assembly or an assembly utilizing provisional outboard outriggers can be carried out instead outboard of a small barge or a support vessel, etc. The above or similar techniques can be used in order to gradually launch the mini-riser to a surface or an off-surface mode. Launching from deck can be used, or an optional ramp can be used that can be inclined or not inclined at an acute angle to the deck. Onshore connection and launching from a beach or from a quay would work as well. If applicable the mini-riser can be towed from the onshore or offshore launching location, to the field, up-ended and connected to the intervention 'Y' fitting. All these and other installation methods are well known to those skilled in the art and need not be described further.

Mini-riser 4545 can utilize rigid joints, like for example metallic joints made of titanium, steel, nickel alloys, aluminum, etc. Mini-riser joints can be also made of Fiber Reinforced Plastics (FRPs) that utilize carbon fiber, graphite fiber, aramid (including Kevlar®) fiber, glass fiber, etc. The use of titanium, FRP joints or flexible pipe is preferred because of their superior bending flexibilities. Achieving a suitable bending flexibility of mini-riser 4545 is the key objective of this design. Mini-riser 4545 is suspended from the top using connector 4570 (or flange).

It is recommended that mini-riser 4545 be very lightly tensioned, where acceptable, i.e. that the effective tension at the intervention 'Y' fitting connector 4555 (or flange) be close to zero, so that the mini-riser remains compliant in all its design conditions. If necessary and safe from environmental protection point of view connector 4555 should be designed for an automatic disconnection in a case of exceeding its design parameters, like for example maximum tension or/and the maximum deflection angle between the min-riser and the axis of the service branch of intervention 'Y' 9270 and any line pressure must be contained. Such a provision may be necessary for example in a case servicing unit 4505 is supported by a different vessel than that on which the catenary riser is installed. In such a case one or two gate valve(s), if used, in intervention 'Y' fitting 9270 may be customized for emergency shearing of coiled tubing or wireline inserted into mini servicing riser 4545. Other disconnection arrangements can also be used.

Covering mini-riser 4545 with positively buoyant coating and/or floatation clamps 4565 in order to achieve the desired tension distribution along its length, which in particular could be essentially neutrally buoyant, or it could be tensioned by its controlled self-weight submerged. The effective length deployed is controlled with appropriate selection of the lengths of the joints deployed, including pup-joints, but additional fine adjustments of the length on mini-riser 4545 can be made by utilizing optional spacer or spacers, optional jacking equipment (hydraulic, screw type, etc.). Mini-riser can be optionally top tensioned, if desired so. Optional top tensioning arrangement (not shown) can be used for that purpose, if required.

The ends of mini-riser 4545 can be optionally provided with stepped or tapered stress joints, bending stiffeners, bending restrictors, etc., as required, item 4560 at the bottom end and/or item 4575 at the top end. In a case mini-riser 4545 is designed to service a range of different sizes of catenary risers, its low end connection 4555 incorporates an adapter to fit any particular flange of the equipment serviced (not shown separately). The adapter will incorporate in its design suitable gradual transition in its internal diameter.

Optional protection from VIVs, if required, can be provided by strakes or 3-D dampers 4580, fairings 4585 or any other effective VIV suppressor or protector.

All the components of the mini-riser systems have to be designed with care and safety in mind. Utilizing relevant sections of industry workover riser codes, recommended practices and specifications should be consulted and used, wherever applicable.

Oil States Industries, Inc. (OSI) for example provide designs of intervention 'Y' fitting and diverter plug removal tooling. That OSI equipment, or similar equipment can be used with this invention, or design modifications to OSI, or similar, intervention 'Y' fittings can be included in the design. Also it may be feasible to design coiled tubing mounted tooling for optional removal of the diverter plug from the intervention 'Y' fitting from the surface using mini service riser 4545 for access, instead of using equipment that is already available commercially. Any other suitable catenary riser intervention arrangement can be used instead of that depicted on FIG. 9, if so desired.

This invention involves a mini-riser connected by its lower end to a service flange of an intervention 'Y' fitting, said intervention 'Y' fitting installed in a general area of and connected to a top of a riser including at least one of a rigid catenary riser, or a metallic catenary riser, or a steel catenary riser, or a titanium catenary riser, or a Chinese lantern riser, or a bottom weighed riser, or a fiber reinforced plastic catenary riser, or a fiber reinforced plastic lazy wave riser, or a flexible riser and said mini-riser is connected above a water surface by an upper end of said mini-riser to a servicing deck attached to at least one of a platform, or a spread moored vessel, or a turret moored vessel, or a disconnectable turret vessel, or an offshore support vessel, or a diving support vessel, or a multipurpose support vessel, or a barge, or a floating buoy, or a submerged buoy, whereas said mini-riser is compliant between its said upper end and its said lower end.

INDUSTRIAL APPLICABILITY

SJSs riser hang-offs are applicable to compliment or to partly replace existing flexible hang-off technology for new installations and for retrofits.

Existing SCR use envelopes including the range of water depths, tensions and the static and dynamic ranges of hang-off angles in which SCRs are used may merit review and possibly adjustments in the view of this new technology. That is in particular relevant to HPHT systems. Current technical envelopes for the use of subsea wells and pipeline and riser systems corresponding may or may not need modifications.

Wider use of SCRs may affect flexible line technology. For example in cases design static hang-off angles from the vertical can be increased, a 'flatter' installation catenary would result with a greater horizontal catenary load component, but possibly considerably less fatigue load in the TDZ.

The mini-riser for riser intervention system suggested compliments the existing intervention technology. It allows carrying out coiled tubing and wireline interventions from above the sea surface and it can be designed as adjustable, portable and compatible with many types of floating production systems.

What is claimed is:

1. A flexible hang-off arrangement for a rigid riser including at least one of a rigid catenary riser, or a metallic catenary riser, or a metallic lazy wave riser, or a steel catenary riser, or a steel lazy wave riser, or a titanium catenary riser, or a titanium lazy wave riser, or a Chinese lantern riser, or a bottom weighed riser, or a fiber reinforced plastic catenary riser, or a fiber reinforced plastic lazy wave riser, or a 'U' shaped rigid catenary jumper, or a 'W' shaped rigid lazy wave jumper;

whereas said rigid riser is indirectly attached to a floater including at least one of a floating platform, or a semisubmersible platform, or a tension leg platform, or a spread moored vessel, or a turret moored vessel, or a disconnectable turret moored vessel, or a floating buoy, or a submerged buoy;

said rigid riser being suspended from a pivoting arrangement attached to said floater; said pivoting arrangement being located in a vicinity of a top of said rigid riser, including said pivoting arrangement essentially coinciding with said top of said rigid riser;

said pivoting arrangement including at least one of a ball joint, or a gimbal, or a universal joint, or a flex joint, or a set of shackles, including a single shackle, or a set of chain links, including a single chain link;

whereas:

a fluid transferred between said rigid riser and said floater and a pressure of said fluid transferred between said rigid riser and said floater are contained in a rigid jumper; whereas said rigid jumper connects a region of said top of said rigid riser, including said top of said rigid riser, with at least one of a piping system of said floater, or a piping system of a turret, or a piping system of a disconnectable turret buoy;

said rigid jumper accommodates rotational deflections of said top of said rigid riser relative said floater;

said rigid jumper includes a gooseneck incorporating a pipe bend, said gooseneck being attached to said rigid riser essentially in said region of said top of said rigid riser in a manner consistent with design pigability requirements of a system of said rigid riser and said rigid jumper and said piping system of said floater;

said gooseneck being incorporated in an entry spool incorporated in said rigid jumper; whereas said entry spool incorporated in said rigid jumper is located at a riser end of said rigid jumper;

whereas said entry spool incorporates two pipe bends, including the pipe bend incorporated in said gooseneck, and whereas said entry spool has implementations incorporating a maximum available of essentially straight segments, including a single essentially straight segment of said rigid jumper, whereas said essentially straight segments of said rigid jumper are adjacent to said two pipe bends incorporated in said entry spool;

said rigid jumper incorporates an exit spool located at a floater end of said rigid jumper; said exit spool incorporating a maximum available of two or one pipe bends of said rigid jumper that are not incorporated in said entry spool, whereas said exit spool has implementations incorporating a maximum available of essentially straight segments, including a single essentially straight segment, of said rigid jumper, whereas said essentially straight segments of said rigid jumper that are incorporated in said exit spool are adjacent to pipe bends incorporated in said exit spool and are not essentially straight segments of said rigid jumper that are incorporated in said entry spool; said floater end of said rigid jumper being located essentially at a support of said piping system of said floater which is a nearest to said top of said rigid riser, while measuring along said rigid jumper;

said rigid jumper has implementations incorporating an additional pup pipe bend of sustained angle not exceeding 20° that is located essentially in a region of one of said floater end of said rigid jumper or of an end of said rigid jumper attached to said region of said top of said rigid riser;

said rigid jumper has implementations incorporating a partial loop, whereas said partial loop is incorporated in said rigid jumper between said entry spool and said exit spool and said partial loop includes all pipe bends and all essentially straight segments available between said entry spool and said exit spool; whereas a sum of all sustained angles of plan shapes of all pipe bends included in said partial loop does not exceed 359°, said plan shapes of all pipe bends included in said partial loop being orthogonal projections of wirelines of said all pipe bends included in said partial loop on a horizontal plane in a floater system of coordinates; whereas wirelines are defined as geometrical loci of geometrical centers of all design orthogonal cross-sections along said rigid jumper, including along subsets of said rigid jumper; said subsets of said rigid jumper including said pipe bends, and including said essentially straight segments, and including said partial loop;

and whereas said rigid jumper provided with said partial loop characterizes with an open plan shape of said partial loop that makes it feasible to install said rigid jumper provided with said partial loop with said rigid riser already installed in place by avoiding interfering with a structure of said rigid riser already installed in place without a need for threading said rigid riser through an area partly surrounded by segments of said partial loop and without a need for threading equipment used to install said rigid riser through said area partly surrounded by said segments of said partial loop, said segments of said partial loop comprising pipe bends and comprising essentially straight segments incorporated in said partial loop.

2. The flexible hang-off arrangement for the rigid riser according to claim 1 whereas the rigid jumper incorporates essentially planar bends, including a single essentially planar bend.

3. The flexible hang-off arrangement for the rigid riser according to claim 1 whereas the rigid jumper incorporates bends, including a single bend, that are provided with three dimensional curvatures.

4. The flexible hang-off arrangement for the rigid riser according to claim 1, whereas a twist angle is introduced between planes tangent to wirelines of neighboring bends incorporated in the rigid jumper.

5. The flexible hang-off arrangement for the rigid riser according to claim 1 utilizing an intervention 'Y' fitting for coiled tubing operations.

6. The flexible hang-off arrangement for the rigid riser according to claim 1 utilizing an intervention 'Y' fitting for wireline operations.

7. The flexible hang-off arrangement for the rigid riser according to claim 1 utilizing a hang-off clamp to support the top of said rigid riser.

8. The flexible hang-off arrangement for the rigid riser according to claim 1 utilizing a structural extension member between the pivoting arrangement and a hang-off clamp supporting the top of said rigid riser.

9. The flexible hang-off arrangement for the rigid riser according to claim 1 utilizing an intervention 'Y' fitting designed for coiled tubing or wireline operations incorporated in a structure of a riser hang-off clamp.

10. The flexible hang-off arrangement for the rigid riser according to claim 1 utilizing a design of a rigid jumper and a design of a floater piping for modifying rotational stiffness characteristics of said flexible hang-off arrangement for said rigid riser.

11. The flexible hang-off arrangement for the rigid riser according to claim 1 utilizing welds, including a single weld, to connect piping segments.

12. The flexible hang-off arrangement for the rigid riser according to claim 1 utilizing connectors, including a single connector, to connect piping segments.

13. The flexible hang-off arrangement for the rigid riser according to claim 1 utilizing flanges, including a single flange, to connect piping segments.

14. The flexible hang-off arrangement for the rigid riser according to claim 1 utilizing suppressors of vortex induced vibrations, including strakes, including 3-D dampers, including perforated shrouds, including fairings.

15. The flexible hang-off arrangement for the rigid riser according to claim 1 utilizing sheltering of the rigid jumper from currents and waves.

16. The flexible hang-off arrangement for the rigid riser according to claim 1, whereas metallic materials including titanium alloys, including steel alloys, including corrosion resistant alloys, including nickel based alloys, including aluminum alloys, including magnesium alloys are used to construct selected segments of the rigid jumper, including entire lengths of said rigid jumper, and to construct selected segments of the piping system of the floater, including entire lengths of said piping system of said floater.

17. The flexible hang-off arrangement for the rigid riser according to claim 1 using non-metallic materials to construct selected segments of the rigid jumper and to construct selected segments of the piping system of the floater, including entire lengths of said rigid jumper and including entire lengths of said piping system of said floater.

18. The flexible hang-off arrangement for the rigid riser according to claim 1 using metallic materials including titanium alloys, steel alloys, corrosion resistant alloys, nickel based alloys, aluminum alloys, magnesium alloys, and using non-metallic materials to line, to clad, to weld overlay selected segments of the rigid jumper and of the piping system of the floater, including entire lengths of said rigid jumper and including entire lengths of said piping system of said floater.

19. The flexible hang-off arrangement for the rigid riser according to claim 1 being retrofitted on a rigid riser originally designed for a different hang-off.

20. The flexible hang-off arrangement for the rigid riser according to claim 1, whereas a maximum design angular deflection of said rigid riser relative the floater exceeds 40° at the hang-off of said rigid riser.

* * * * *